US008231393B2

(12) United States Patent
Liang

(10) Patent No.: US 8,231,393 B2
(45) Date of Patent: Jul. 31, 2012

(54) CONNECTION RECEPTACLE LOCK AND SECURITY STRUCTURE

(76) Inventor: Yu-Tai Liang, Taipei County (TW)

( * ) Notice: Subject to any disclaimer, the term of this patent is extended or adjusted under 35 U.S.C. 154(b) by 223 days.

(21) Appl. No.: 12/836,776

(22) Filed: Jul. 15, 2010

(65) Prior Publication Data

US 2011/0300727 A1 Dec. 8, 2011

(30) Foreign Application Priority Data

Jun. 8, 2010 (TW) ..... 99210890 U

(51) Int. Cl.
*H01R 13/44* (2006.01)

(52) U.S. Cl. ..... 439/133; 439/676

(58) Field of Classification Search ..... 439/133, 439/676, 541.5, 353
See application file for complete search history.

(56) References Cited

U.S. PATENT DOCUMENTS 6,890,197 B2 * 5/2005 Liebenow ..... 439/188
7,108,564 B2 * 9/2006 Liao ..... 439/676
7,361,047 B2 * 4/2008 Strahl ..... 439/354
7,540,756 B1 * 6/2009 Strahl ..... 439/354
2004/0029450 A1 * 2/2004 Chen ..... 439/676
2005/0037670 A1 * 2/2005 Clark et al. ..... 439/676
2006/0009083 A1 * 1/2006 Liao ..... 439/676
2006/0084324 A1 * 4/2006 Liao ..... 439/676

* cited by examiner

*Primary Examiner* — Tulsidas C Patel
*Assistant Examiner* — Phuongchi Nguyen
(74) *Attorney, Agent, or Firm* — Rosenberg, Klein & Lee

(57) ABSTRACT

A lock and security structure for a connection receptacle includes a connection port, a pawl portion, and a lock and security portion. The connection port forms a receiving space and a slide channel in the receiving space. The pawl portion includes a fixed end and the pawl portion is located adjacent to an end surface of the connection port. The pawl portion forms at least one barb. The lock and security portion includes a bar portion and a board portion. The bar portion is formed on one end of the board portion. The lock and security portion is movable along the slide channel in the slide channel. When the lock and security portion is moved to a first position, the bar portion engages the pawl portion and when moved to a second position the bar portion disengages from the pawl portion.

15 Claims, 25 Drawing Sheets

CONNECTION RECEPTACLE LOCK AND SECURITY STRUCTURE

FIELD OF THE INVENTION

The present invention relates to a connection receptacle, and in particular to a lock and security structure of a connection receptacle that is particularly applicable to network connection receptacles and telephone connection receptacles.

BACKGROUND OF THE INVENTION

Telephone cables, network cables, or power cables are often embedded in a wall or floor of a building. This is particularly true for commercial architectures, such as an office building, a commercial building, and a hotel, that often sets up these cables by burying the cables in the walls and/or floors of the building with connection receptacles or sockets exposed on wall surfaces or floor grounds of the building. This is for aesthetic and convenient purposes.

To use the cable systems, a user inserts a mating plug into the corresponding receptacle. For example, to connect to a computer network, a user inserts a network connection cable into a receptacle of the network cable buried in the building. Some of the hotels provide network connection service to their residents in order to allow their residents to surf the Internet or to connect to private networks. These receptacles for computer network or telephone network are put into operation by simply inserting a mating connection cable. This is convenient for easy removal and connection of the connection cable, but it is disadvantageous that the connection cable may easily get lost.

Thus, the present invention aims to provide a connection receptacle lock and security structure that is advantageous in respect of simple structure, effective prevention of stealing, protection against unauthorized connection, and easy use, so as to overcome the problems of a connection cable being easily stolen and a receptacle being connected without proper authorization that are often found in the existing connection receptacles or sockets.

SUMMARY OF THE INVENTION

An objective of the present invention is to provide a connection receptacle lock and security structure, which features a combination of a connection port, a pawl portion, and a lock and security portion to make the connection receptacle lock and security structure advantageous in respect of simple structure, easy assembling, protection against unauthorized connection, effective prevention of stealing, and easy use, and thus the present invention is practical, advanced and convenient in use.

To achieve the above objective, the present invention provides a connection receptacle lock and security structure, which comprises a connection port, a pawl portion, and a lock and security portion. The connection port forms a receiving space and a slide channel. The slide channel is defined in a surface of the receiving space. The pawl portion comprises at least one fixed end and the pawl portion is located adjacent to an end surface of the connection port. The pawl portion forms at least one barb. The lock and security portion comprises a bar portion and a board portion. The bar portion is formed on one end of the board portion. The lock and security portion is movable along the slide channel in an extension direction of the slide channel. When the lock and security portion is moved to a first position, the bar portion engages the pawl portion so that the board portion of the lock and security portion and an opposite end surface of the connection port together form a barrier that prevents an external connection plug from being inserted into the connection port and/or prevents a connection plug that is already received in the connection port from undesirably separating from the connection port. When the lock and security portion is moved to a second position, the bar portion disengages from the pawl portion so that due to the movement, the barrier that was formed of the board portion of the lock and security portion and the opposite end surface of the connection port is removed to allow a connection plug that is received in the connection port to be removed therefrom, or to allow an external connection plug to be inserted into an occupied connection port.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
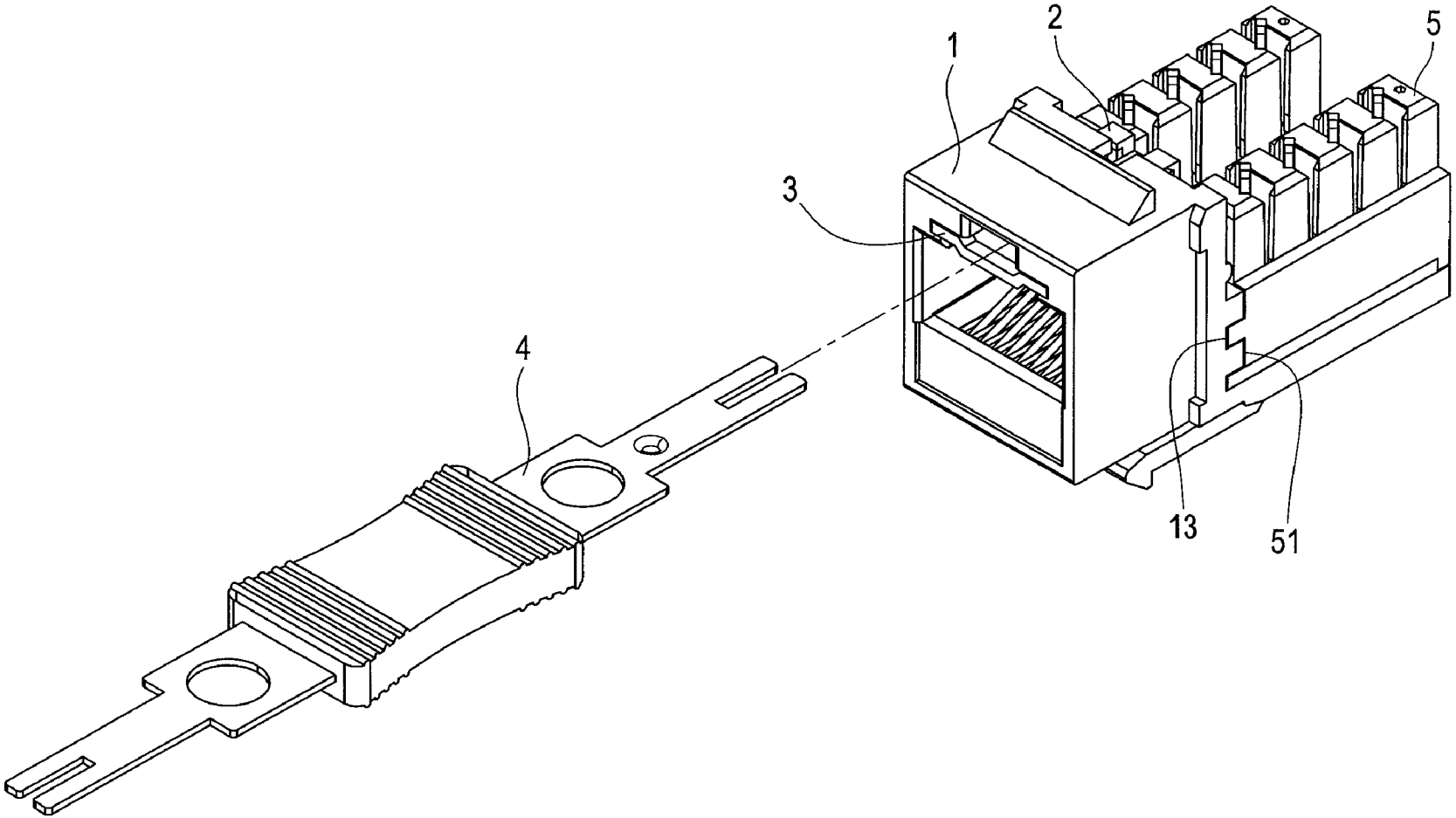
FIG. 1 is a perspective view showing a connection receptacle lock and security structure according to a first embodiment of the present invention.
Figure 2:
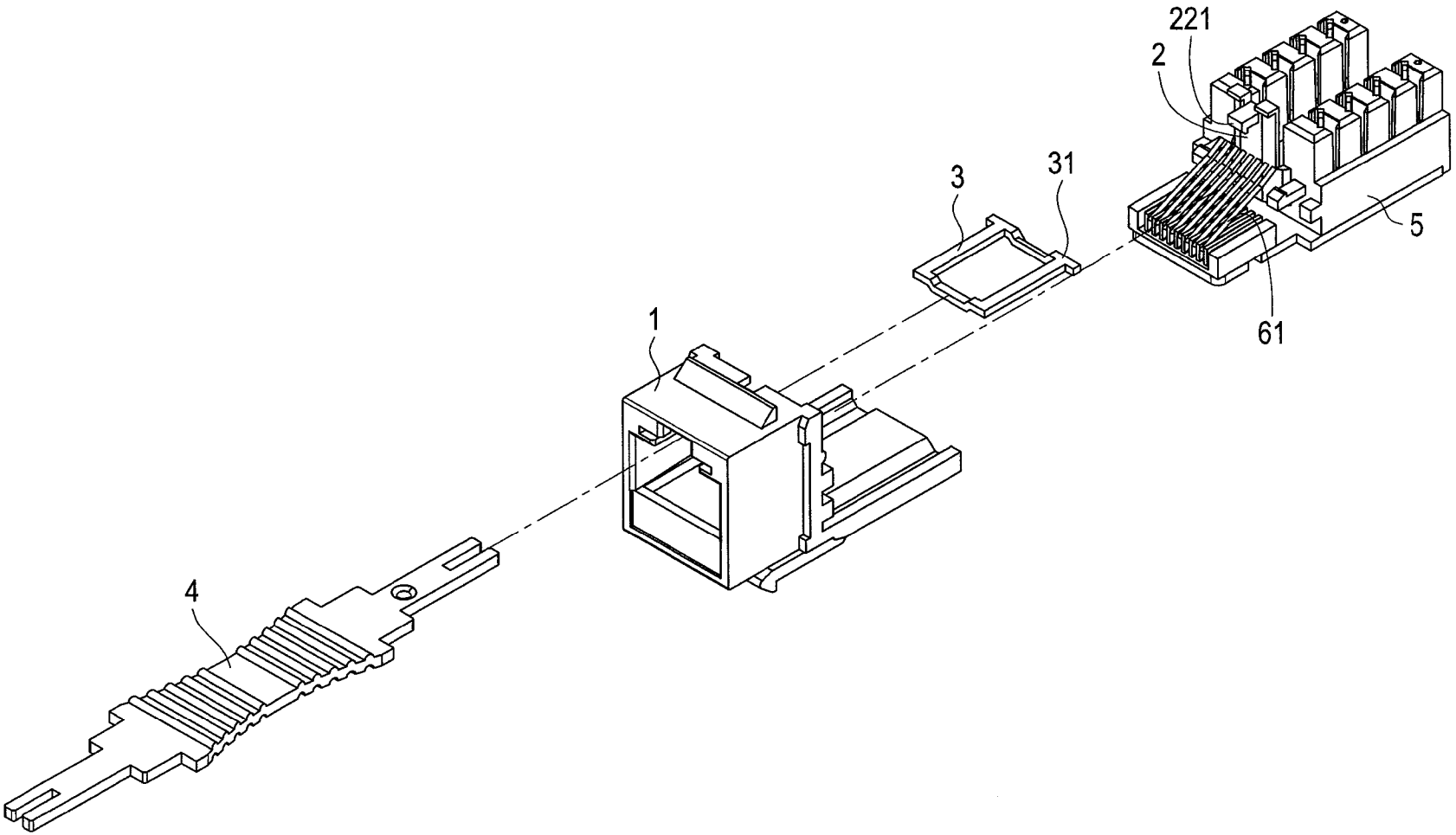
FIG. 2 is an exploded view of the connection receptacle lock and security structure according to the first embodiment of the present invention.
Figure 3:
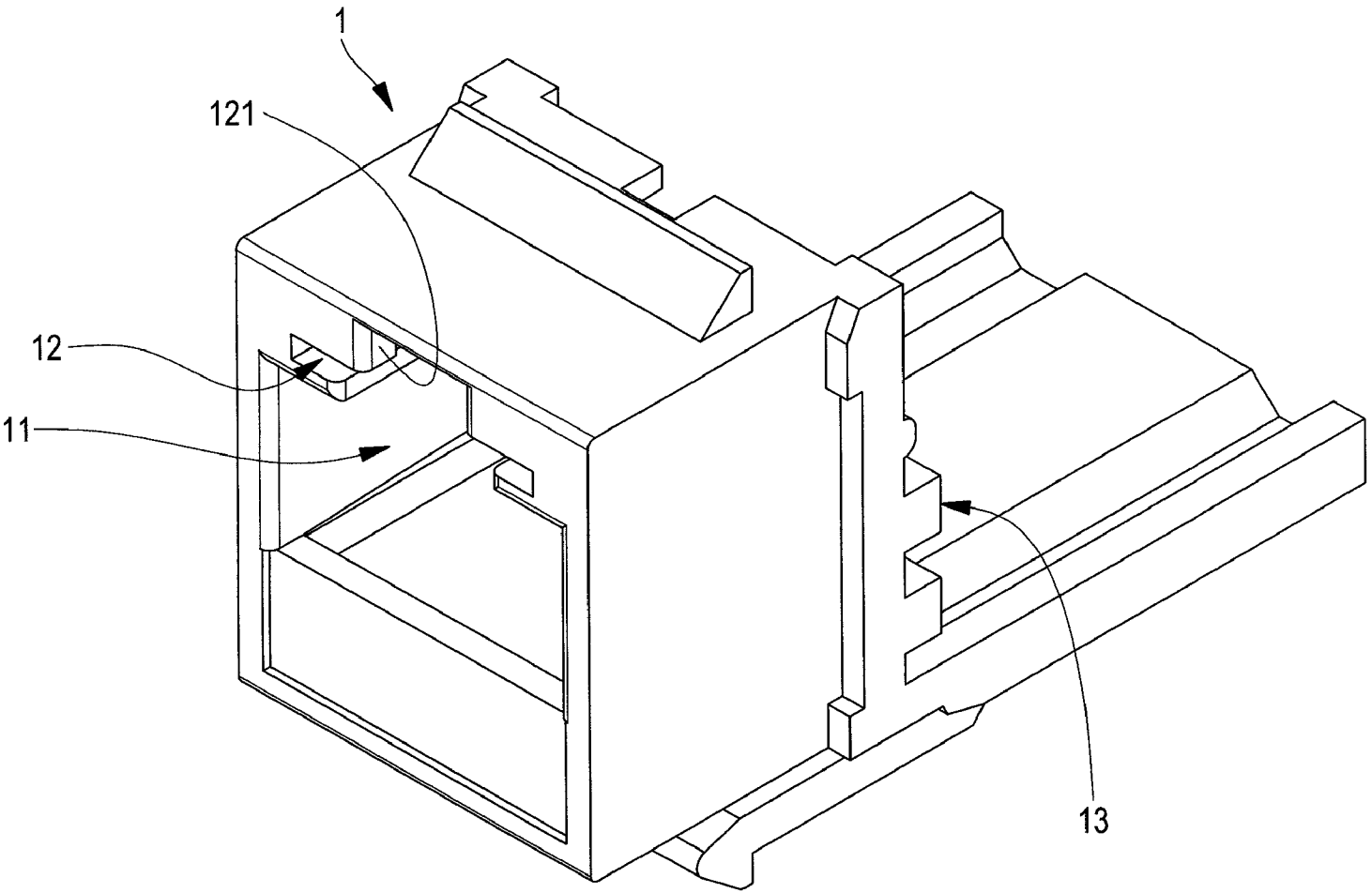
FIG. 3 is a perspective view showing a connection port of the connection receptacle lock and security structure according to the first embodiment of the present invention.
Figure 4:
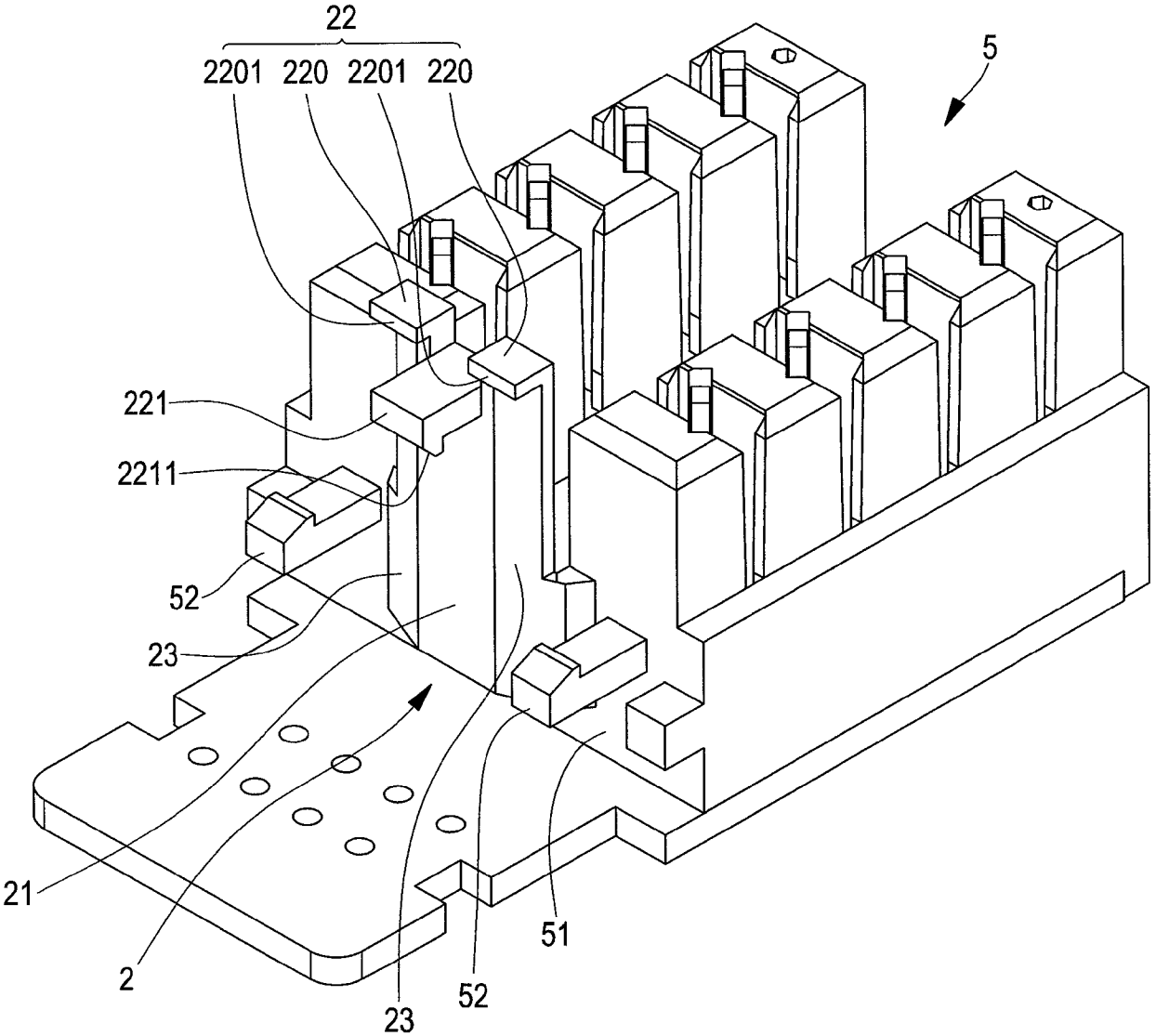
FIG. 4 is a perspective view showing a pawl portion and a terminal housing of the connection receptacle lock and security structure according to the first embodiment of the present invention.
Figure 5:
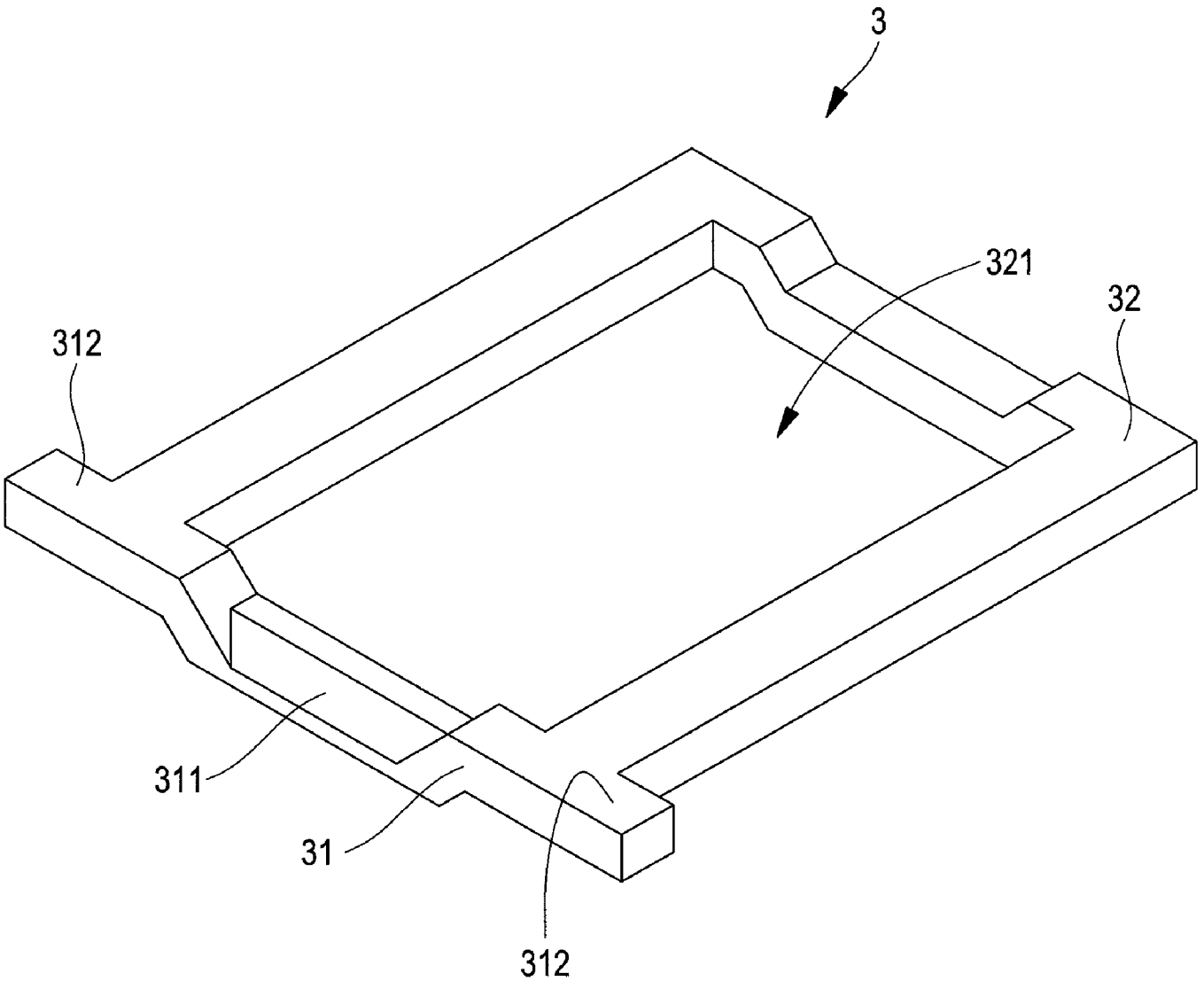
FIG. 5 is a perspective view showing a lock and security portion of the connection receptacle lock and security structure according to the first embodiment of the present invention.
Figure 6:
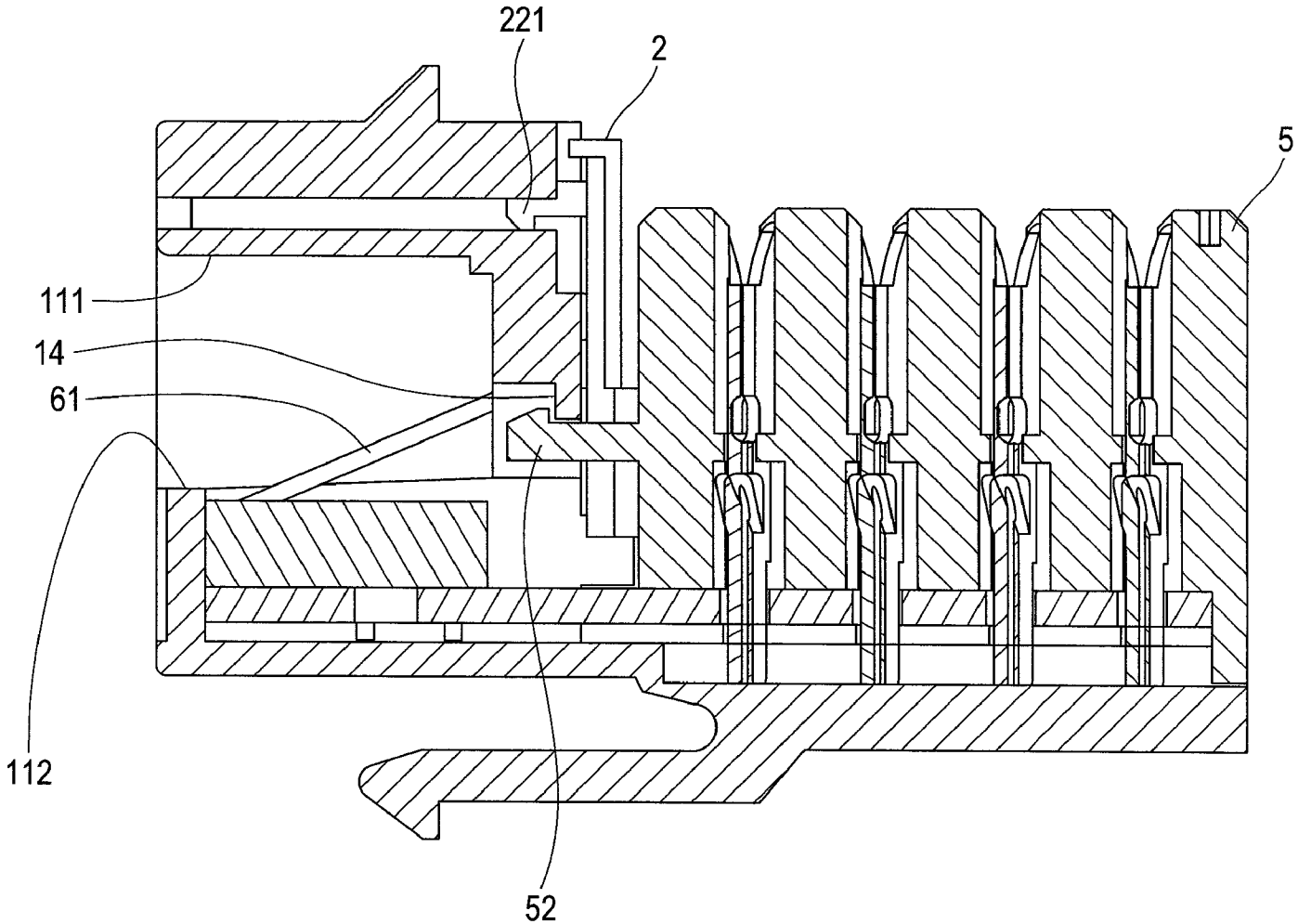
FIG. 6 is cross-sectional view showing the connection receptacle lock and security structure according to the first embodiment of the present invention.
Figure 7:
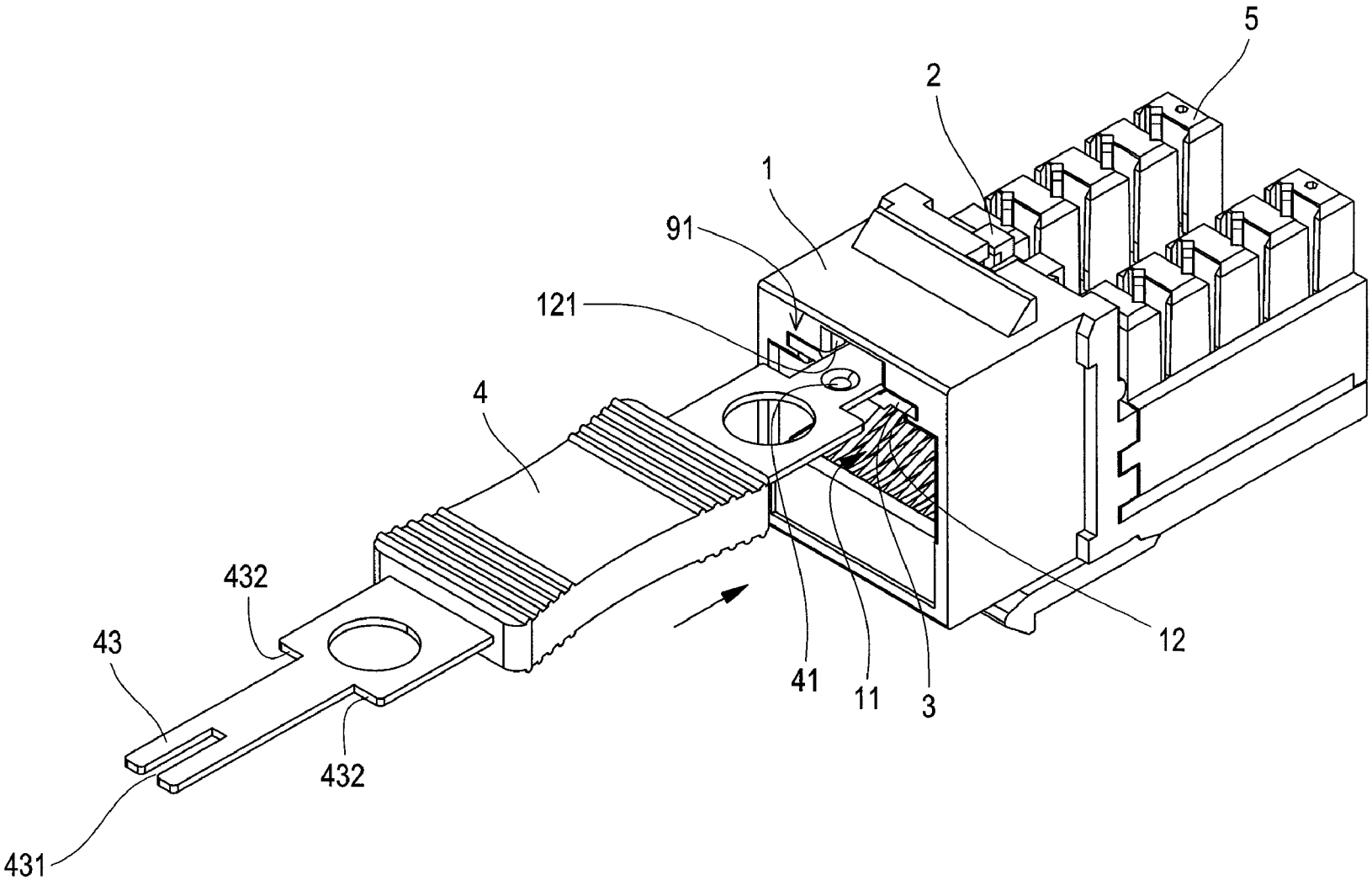
FIG. 7 is a perspective view showing a separator inserted into the connection port to drive the lock and security portion of the connection receptacle lock and security structure according to the first embodiment of the present invention.
Figure 7A:
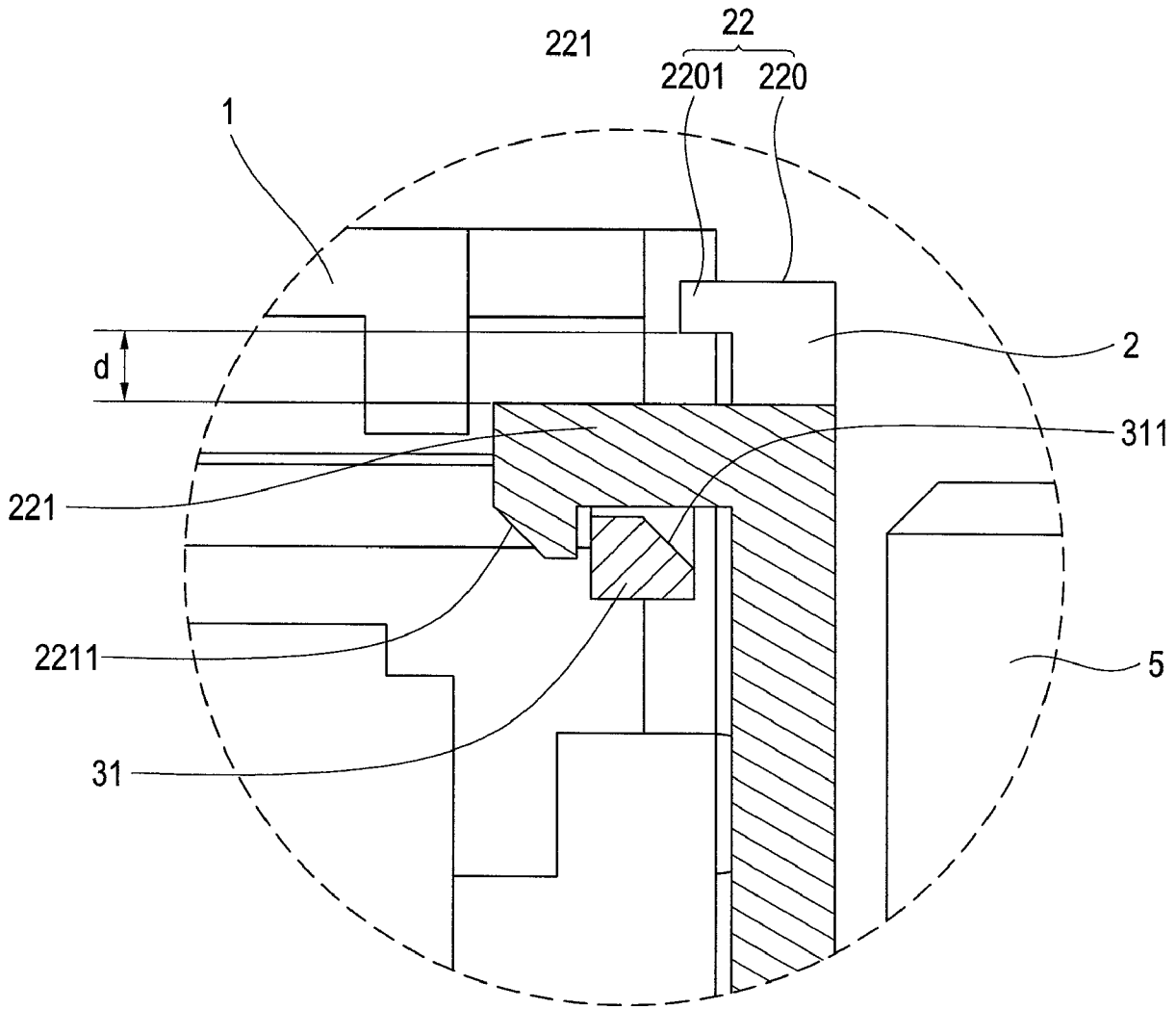
FIG. 7A is a cross-sectional view showing the engagement between the lock and security portion and the pawl portion of the connection receptacle lock and security structure according to the first embodiment of the present invention.
Figure 8:
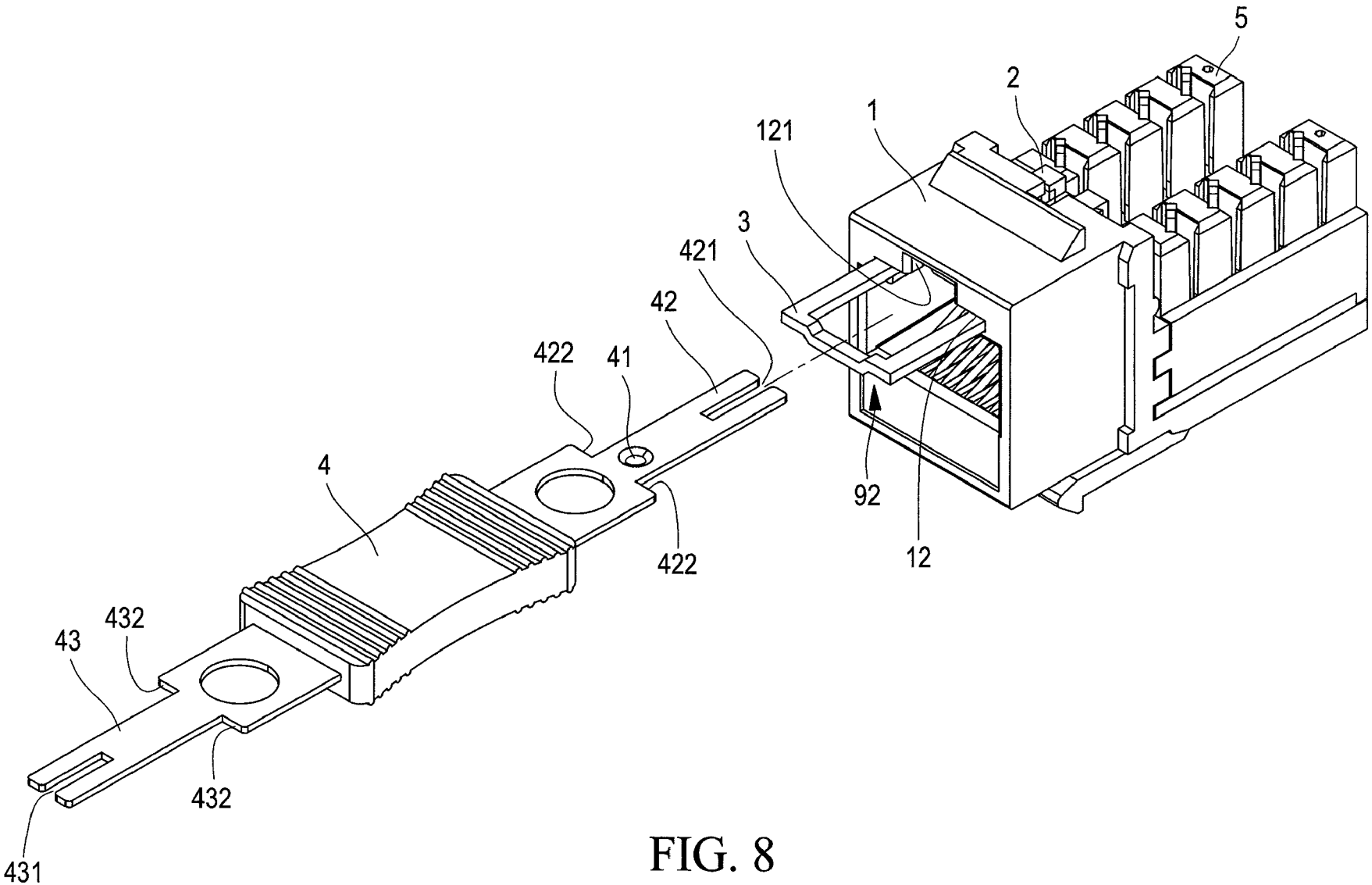
FIG. 8 is a perspective view showing the separator removed out of the connection port to drive the lock and security portion of the connection receptacle lock and security structure according to the first embodiment of the present invention.
Figure 9:
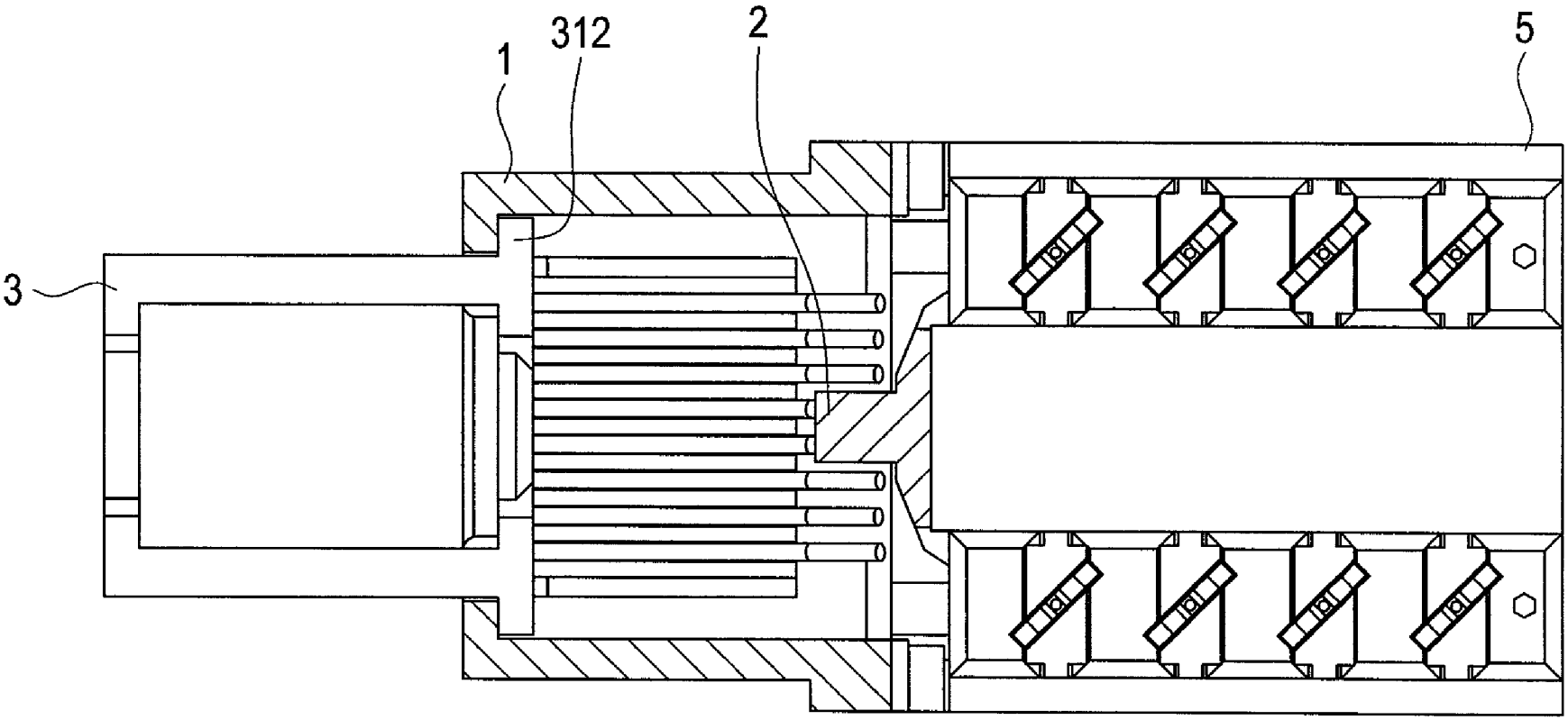
FIG. 9 is a cross-sectional view showing the use of the connection receptacle lock and security structure according to the first embodiment of the present invention.

With reference to the drawings and in particular to FIGS. 1-6, which show a perspective view and an exploded view of a connection receptacle lock and security structure according to a first embodiment of the present invention, a perspective view of a connection port of the first embodiment of the present invention, a perspective view of a pawl portion and a terminal housing of the first embodiment of the present invention, a perspective view of a lock and security portion of the first embodiment of the present invention, and a cross-sectional view of the connection receptacle lock and security structure of the present invention, the connection receptacle lock and security structure according to the present invention comprises a connection port 1, a pawl portion 2, a lock and security portion 3, a separator 4, and a terminal housing 5.

The connection port 1 forms a receiving space 11 and comprises a plurality of conductive wires 61, a slide channel 12, an end surface 13, and at least one retention slot 14. The slide channel 12 is formed in one surface 111 of the receiving space 11. A slide groove 121 is formed inside the slide channel 12 and is set in a direction along which the slide channel 12 extends. The slide groove 121 forms therein a guide block 122 (also see FIG. 13). The plurality of conductive wires 61 is set on an opposite surface 112 of the receiving space 11. The pawl portion 2 is of a cantilever beam like structure, comprising a fixed end 21 and a free end 22 between which a guard surface 23 is formed. The guard surface 23 comprises two inclined faces that are respectively formed on two sides of the pawl portion 2 and inclined from a center of the pawl portion 2 toward the opposite edges of the two sides. (In a practical example, the guard surface 23 can be a curved surface.) The free end 22 is composed of two top portions 220 and a barb 221 between the top portions. Each top portion 220 forms protrusion 2201 extending in a direction toward the receiving space 11. The top portions 220 are of an L-shaped cross-section. The barb 221 is located at a central portion of the free end 22. The barb 221 is spaced from the protrusions 2201 of the top portions 220 of the free end 22 by a distance d. The barb 221 forms a first guide surface 2211. The lock and security portion 3 is composed of a bar portion 31 and a board portion 32. The bar portion 31 forms a second guide surface 311 and two stop blocks 312 on opposite sides of the second guide surface 311. The bar portion 31 is set at one end of the board portion 32. The second guide surface 311 corresponds in position to the first guide surface 2211 of the barb 221. (In a practical example, the first guide surface 2211 and the second guide surface 311 are slopes, curved surface, or flat surfaces.) The stop blocks 312 are formed on opposite side portions of the bar portion 31 and project beyond opposite side edges of the board portion 32 respectively. The board portion 32 forms an opening 321.

The separator 4 comprises a projection 41, a first U-shaped end 42, and a second U-shaped end 43. The first U-shaped end 42 and the projection 41 are located at one end section of the separator 4, while the second U-shaped end 43 is located at an opposite end section of the separator 4. The first U-shaped end 42 and the second U-shaped end 43 of the separator 4 are arranged to selectively engage and drive the free end 22 of the pawl portion 2. The first U-shaped end 42 and the second U-shaped end 43 of the separator 4 are of identical thickness. Further, the thickness of the first U-shaped end 42 of the separator 4 is less than the distance d. The first U-shaped end 42 forms a first opening 421, and the second U-shaped end 43 forms a second opening 431. The terminal housing 5 comprises an end surface 51 and at least one coupling member 52.

The lock and security portion 3 is movably received in the slide channel 12 of the connection port 1, whereby the lock and security portion 3 is slidable along the extension direction of the slide channel 12 to take a displacement. The fixed end 21 of the pawl portion 2 is mounted to the end surface 51 of the terminal housing 5, and the end surface 51 of the terminal housing 5 is arranged to oppose the end surface 13 of the connection port 1. The coupling member 52 corresponds in position to the retention slot 14 of the receiving space 11 of the connection port 1. When the end surface 51 of the terminal housing 5 and the end surface 13 of the connection port 1 are positioned in contact with or close to each other, the coupling member 52 of the terminal housing 5 and the retention slot 14 of the connection port 1 mate and couple to each other.

To use, as shown in FIGS. 7, 7A, 8, and 9, which demonstrate an operation of use of the connection receptacle lock and security structure according to the first embodiment of the present invention, with the connection port 1 and the terminal housing 5 coupled to each other, the lock and security portion 3 is caused to move along the slide channel 12 to a first position 91, the first guide surface 2211 of the barb 221 is forced to move along the second guide surface 311 to then engage the bar portion 31, whereby the board portion 32 of the lock and security portion 3 and an opposite end surface of the connection port 1 together form a barrier that prevents an external connection plug from being inserted into the connection port and/or prevents a connection plug that is already received in the connection port 1 from undesirably separating from the connection port 1. When a user (not shown) attempts to insert a connection cable 7 into the receiving space 11 of the connection port 1, the board portion 32 of the lock and security portion 3 interferes with a projecting portion 71 of the connection cable 7, making it not possible for the connection cable 7 to insert into the receiving space 11 of the connection port 1. Consequently, before a connection cable 7 is inserted into the receiving space 11 of the connection port 1, the lock and security portion 3 must be first moved to a second position 92, whereby due to the movement, the barrier that was formed of the board portion 32 of the lock and security portion 3 and the opposite end surface of the connection port 1 is removed to allow a connection plug that is received in the connection port 1 to be removed therefrom, or to allow an external connection plug to be inserted into an occupied connection port 1. The projecting portion 71 of the connection cable 7 is only allowed to engage the lock and security portion 3 under such a condition.

To make the movement, the user first inserts the first U-shaped end 42 of the separator 4 into the slide groove 121, making the first U-shaped end 42 moving along the extension direction of the slide groove 121 into the connection port 1, whereby the guide block 122 is received into the first opening 421 of the first U-shaped end 42 to guide the movement of the separator 4. Next, when the first U-shaped end 42 moves past the barb 221 and gets into contact with the free end 22 of the pawl portion 2 below the protrusions 2201, further insertion of the separator 4 in the extension direction of the slide groove 121 causes the first U-shaped end 42 of the separator 4 to apply a force to the free end 22 of the pawl portion 2. The force causes the free end 22 of the pawl portion 2 to undergo elastic deformation, making the bar portion 31 separating from the barb 221. Then, the projection 41 of the separator 4 gets into the opening 321 of the board portion 32. Thereafter, by driving the separator 42 along the extension direction of the slide groove 121 to move outward of the connection port 1, the projection 41 of the separator 4 drives the board portion 32 to move in unison therewith. It is noted that with continuous movement of the separator 4, first stop edges 422 of the separator 4 are brought into contact with a wall of the connection port 1 to stop the movement of the separator 4. The lock and security portion 3 is then moved in the extension direction of the slide channel 12 to the second position 92 and separated from the barb 221. When the lock and security portion 3 reaches the second position 92, the stop block 312 of the lock and security portion 3 is set in engagement with a wall of the connection port 1 to stop further movement of the lock and security portion 3, whereby the lock and security portion 3 is prevented from separating from the connection port 1 to get lost or cause inconvenience in use. (In a practical example, the bar portion 31 and the board portion 32 of the lock and security portion 3 can be integrally formed together as a unitary frame, or alternatively, the board portion 32 forms coupling means that couples the projecting portion 71 of the connection cable 7 to prevent the connection cable 7 from undesired separation.)

Figure 10:
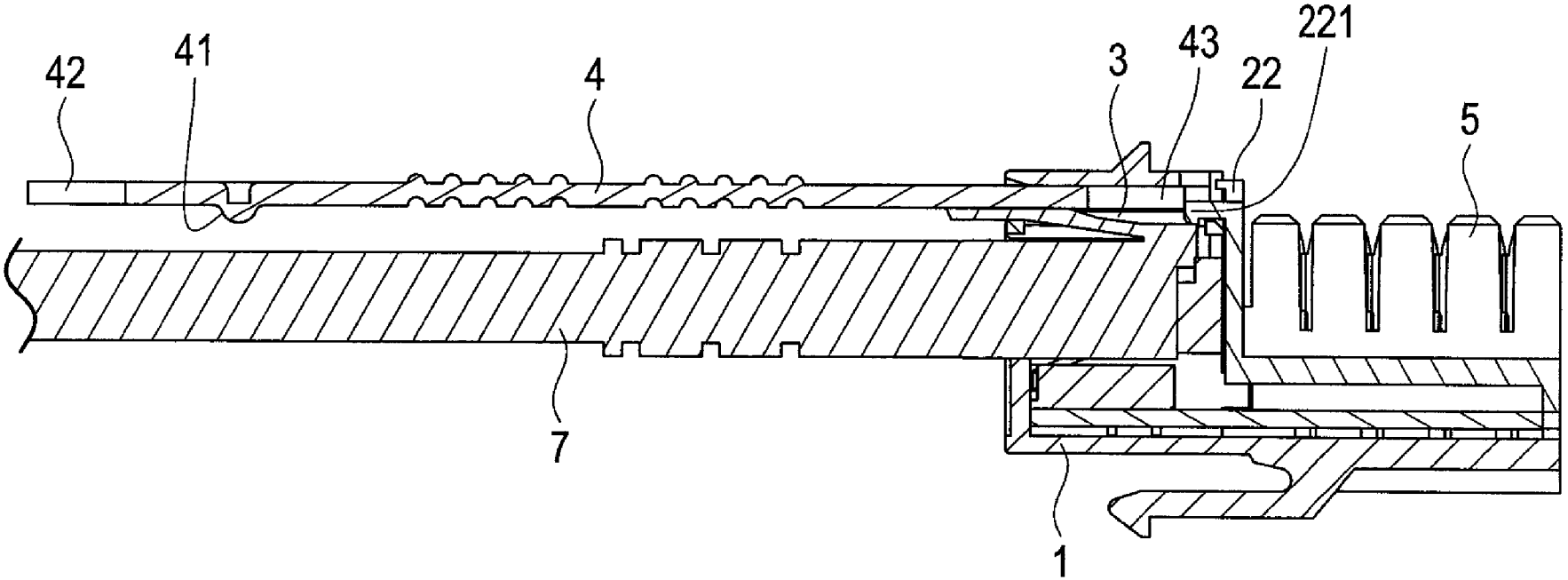
FIG. 10 is a cross-sectional view showing a connection cable, the lock and security portion, and the separator inserted into the connection port of the connection receptacle lock and security structure according to the first embodiment of the present invention.
Figure 10A:
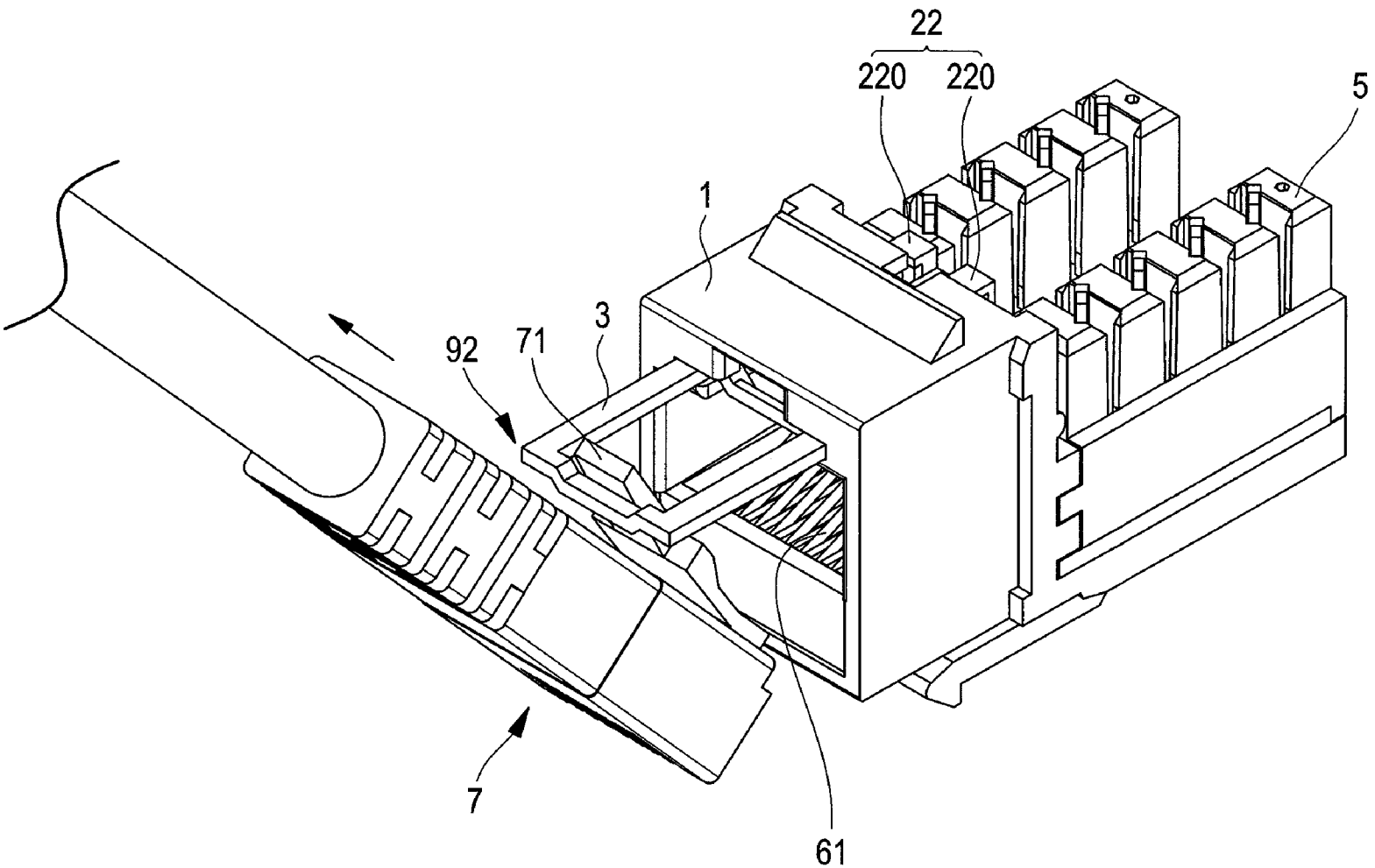
FIG. 10A is a perspective view showing a first phase of the connection cable inserting into the connection port of the connection receptacle lock and security structure according to the first embodiment of the present invention.
Figure 10B:
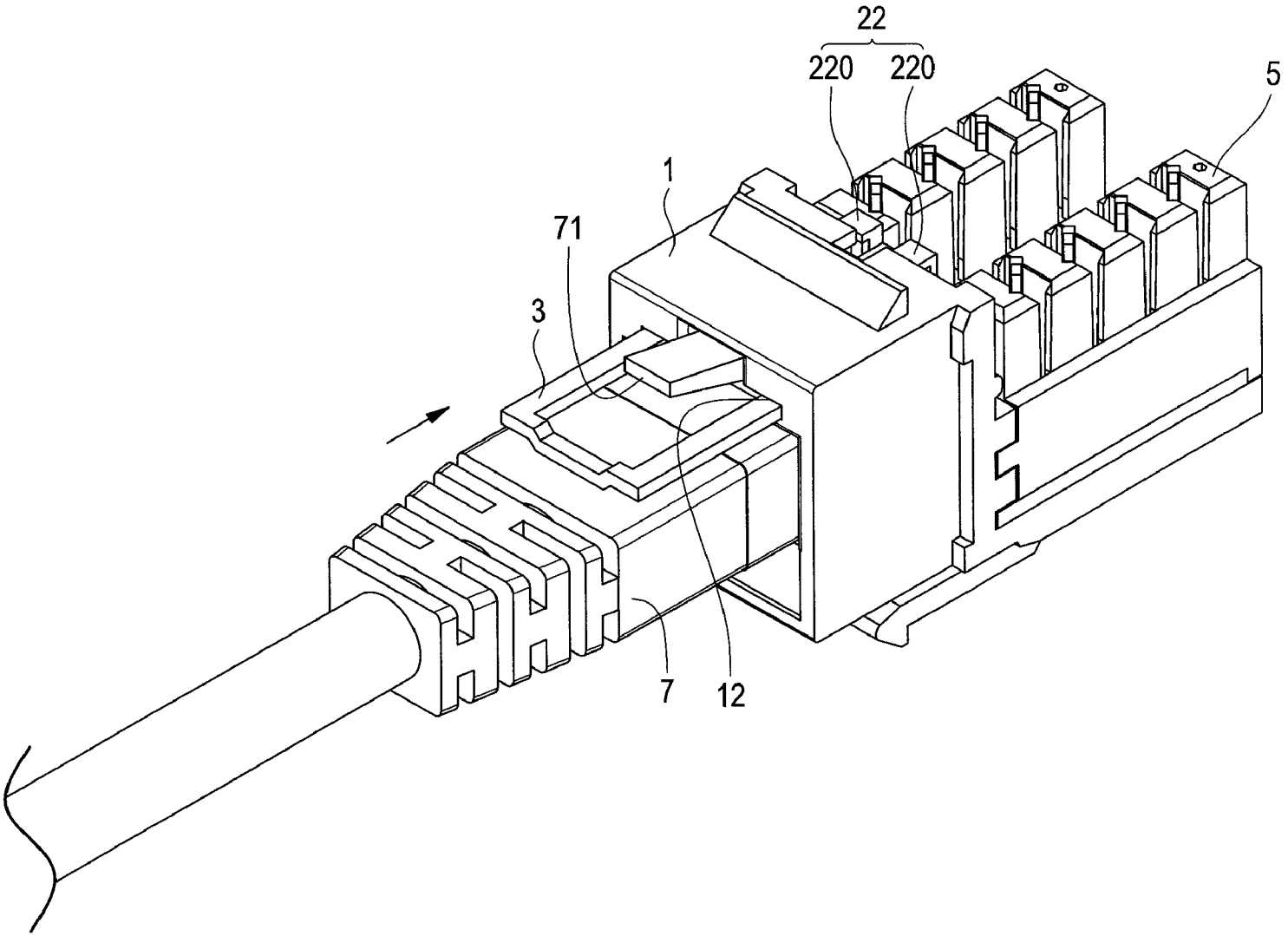
FIG. 10B is a perspective view showing a second phase of the connection cable inserting into the connection port of the connection receptacle lock and security structure according to the first embodiment of the present invention.
Figure 10C:
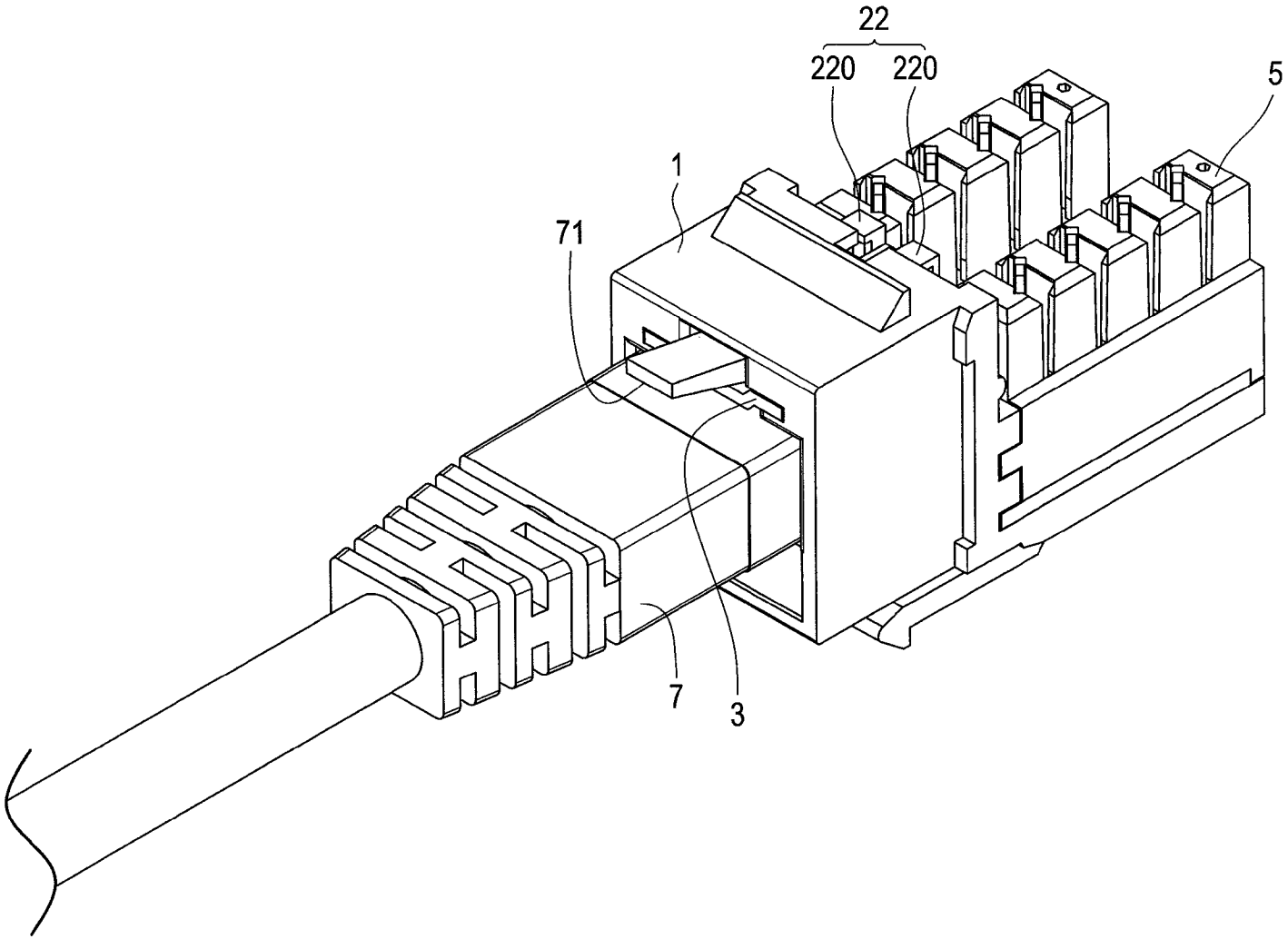
FIG. 10C is a perspective view showing a third phase of the connection cable inserting into the connection port of the connection receptacle lock and security structure according to the first embodiment of the present invention.

As shown in FIG. 10-10C, which demonstrate the first to third phases of an operation of inserting a connection cable into the connection port of the connection receptacle lock and security structure according to the first embodiment of the present invention, with the lock and security portion 3 being moved along the slide channel 12 to the second position 92, the user places the projecting portion 71 of the connection cable 7 into the opening 321 of the lock and security portion 3 (as shown in FIG. 10A) so that the projecting portion 71 of the connection cable 7 are set in engagement with the board portion 32 of the lock and security portion 3. The connection cable 7 is then pushed into the receiving space 11 of the connection port 1 (as shown in FIG. 10B). Afterwards, the lock and security portion 3 is moved along the slide channel 12 to the first position 91. The lock and security portion 3, when moved to the first position 91, locks and prevents the connection cable 7 from undesired removal and also prevents the connection cable 7 from getting loosened and thus separating from the connection port 1. Under this condition, the connection cable 7 is set in engagement with the plurality of conductive wires 61 of the connection port 1 (as shown in FIGS. 10 and 10C).

Figure 11A:
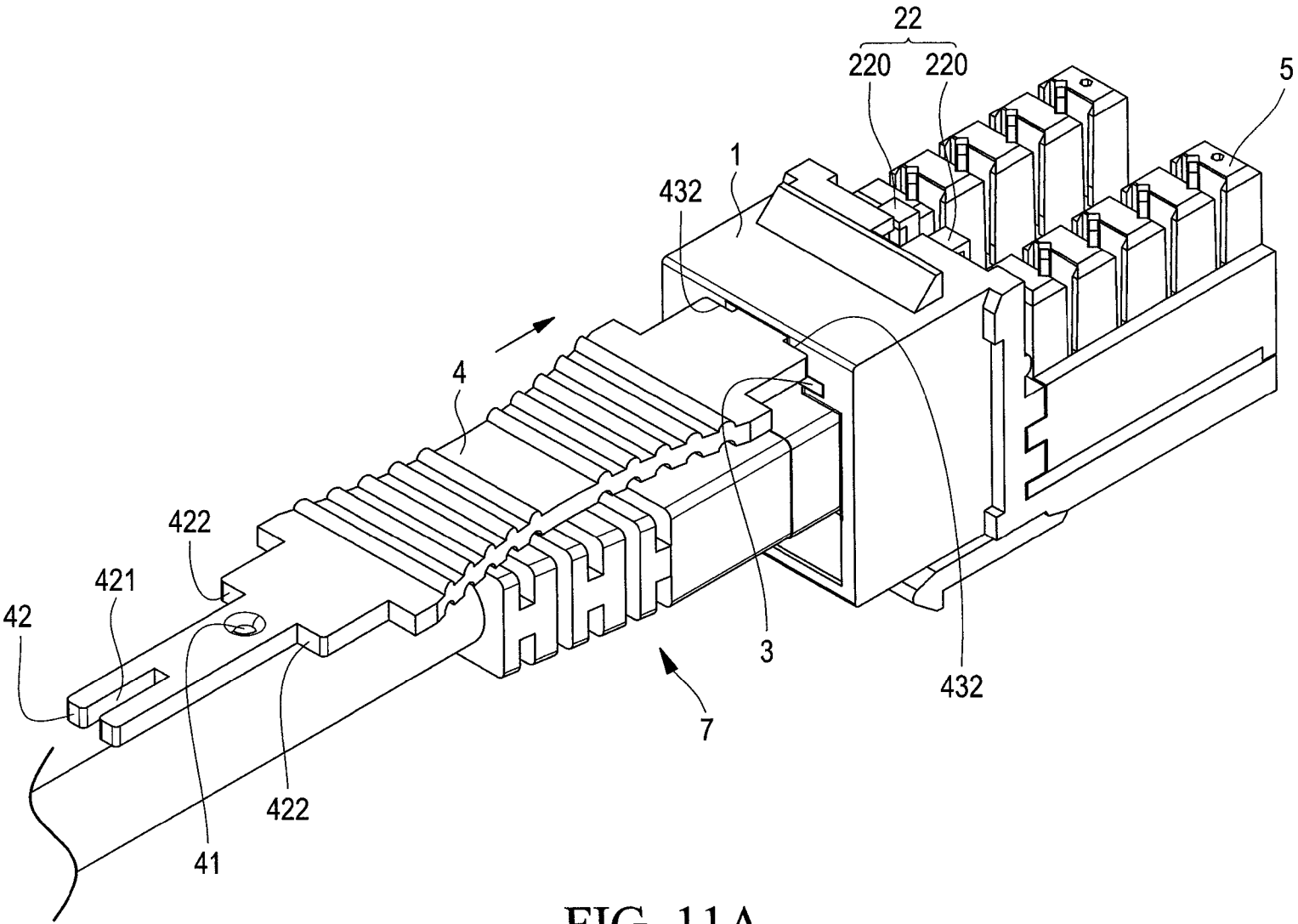
FIG. 11A is a perspective view showing a first phase of the connection cable removing from the connection port of the connection receptacle lock and security structure according to the first embodiment of the present invention.
Figure 11B:
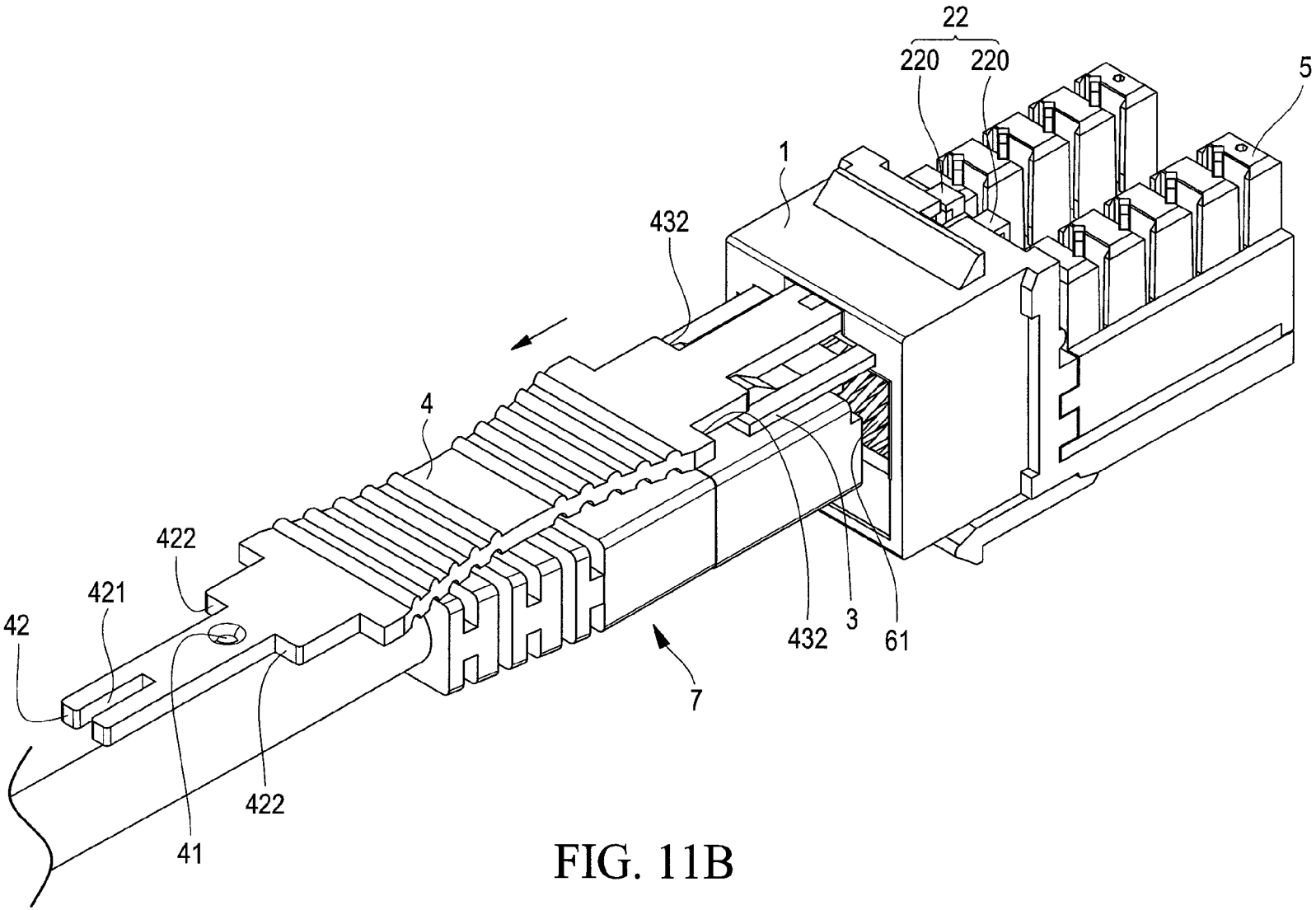
FIG. 11B is a perspective view showing a second phase of the connection cable removing from the connection port of the connection receptacle lock and security structure according to the first embodiment of the present invention.
Figure 11C:
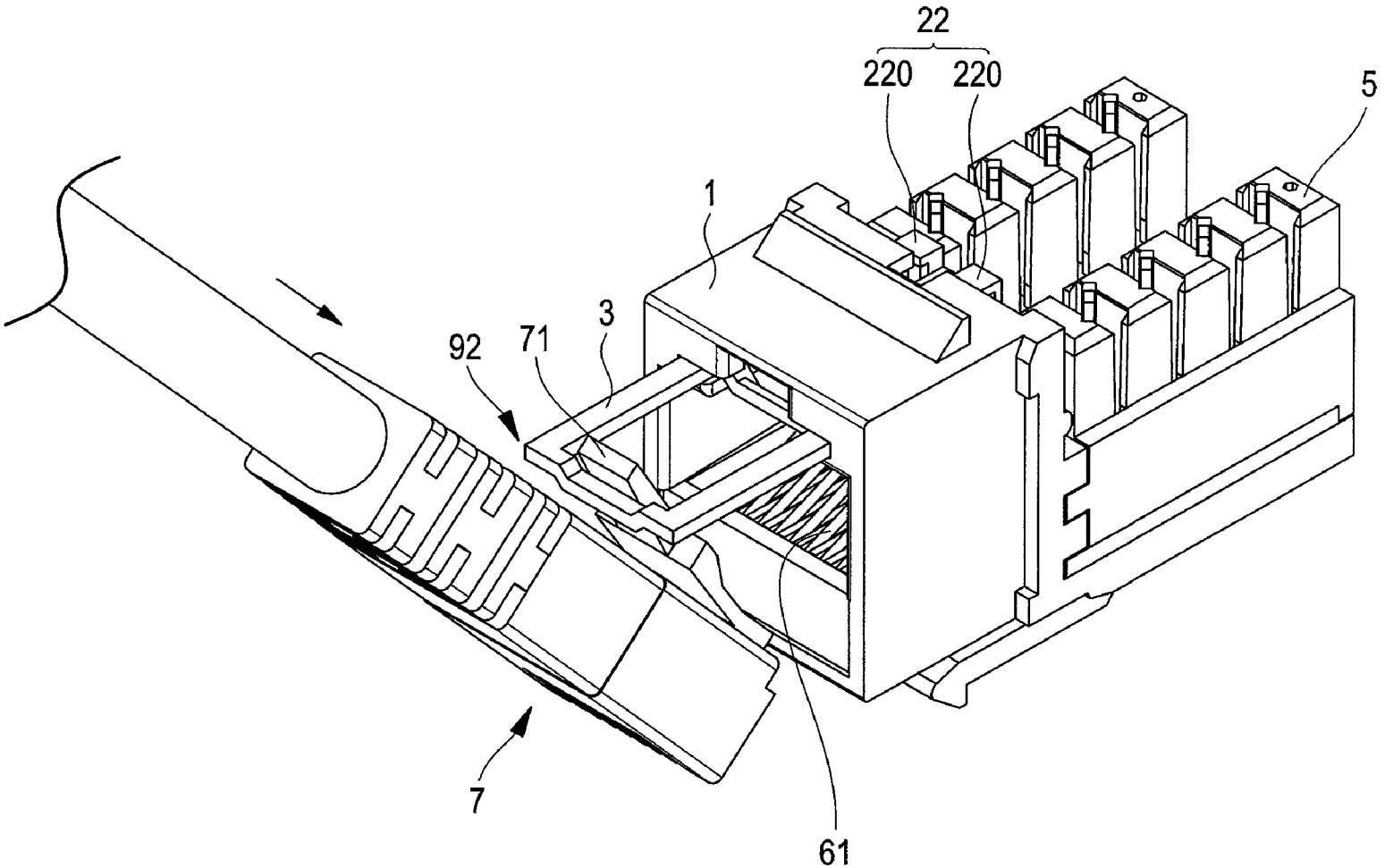
FIG. 11C is a perspective view showing a third phase of the connection cable removing from the connection port of the connection receptacle lock and security structure according to the first embodiment of the present invention.

As shown in FIGS. 11A-11C, which demonstrate the first to third phases of an operation of removing a connection cable from the connection port of the connection receptacle lock and security structure according to the first embodiment of the present invention, to remove the connection cable 7 from the connection port 1, the user inserts the second U-shaped end 43 of the separator 4 into the slide groove 121 (as shown in FIGS. 10 and 11A). The second U-shaped end 43 moves in the extension direction of the slide groove 121 inwardly into the connection port 1 to get into engagement with the free end 22 of the pawl portion. The user further pushes the separator 4 inwardly in the extension direction of the slide groove 121, making the second U-shaped end 43 of the separator 4 applying a force to the free end 22 of the pawl portion 2. The force causes an elastic deformation of the free end 22 of the pawl portion 2 to separate the bar portion 31 from the barb 221. Then, the separator 42 and the connection cable 7 are together moved outwardly of the connection port 1 through movement along the extension direction of the slide groove 121 (as shown in FIG. 11B). The connection cable 7 will also drive the lock and security portion 3 to move to the second position 92, where the connection cable 7 is allowed to remove out of the opening 321 of the lock and security portion 3 to complete the operation of removing the connection cable (as shown in FIG. 11C).

Further, when the connection cable 7 is received and retained in the connection receptacle lock and security structure according the present invention, if a person inserts a sharp-tip object to along the slide groove 121 inwardly into the connection port 1, the sharp-tip object will engage the guard surface 23 of the free end 22 of the pawl portion 2. Due to the guard surface 23 being inclined surfaces, when the sharp-tip object is forced inward, attempting to apply a push to the guard surface 23 of the free end 22, the sharp-tip object is guided by the guard surface 23 to slide sideways and does not cause elastic deformation and displacement of the free end 22, whereby the bar portion 31 maintains in engagement with the barb 221. The connection cable 7 cannot be removed from the connection receptacle lock and security structure of the present invention in this way.

If a person inserts a plate-like object along the slide groove 121 inwardly into the connection port 1, the plate-like object will be blocked by the guide block 122 of the slide groove 121 and is thus prevented from reaching and engaging the free end 22. Consequently, the bar portion 31 will not be separated from the barb 221 and the connection cable 7 cannot be removed from the connection receptacle lock and security structure of the present invention in this way.

As such, once the connection cable 7 is inserted into the connection receptacle lock and security structure, the engagement established between the barb 221 of the pawl portion 2 and the bar portion 31 of the lock and security portion 3 fixes the connection cable 7 in the connection receptacle lock and security structure. To remove the connection cable 7 from the connection port 1, the separator 4 must be applied to separate the connection cable 7 from the connection receptacle lock and security structure. Consequently, the connection receptacle lock and security structure according to the present invention effectively prevents the connection cable 7 from being stolen and being arbitrarily connected.

Figure 12:
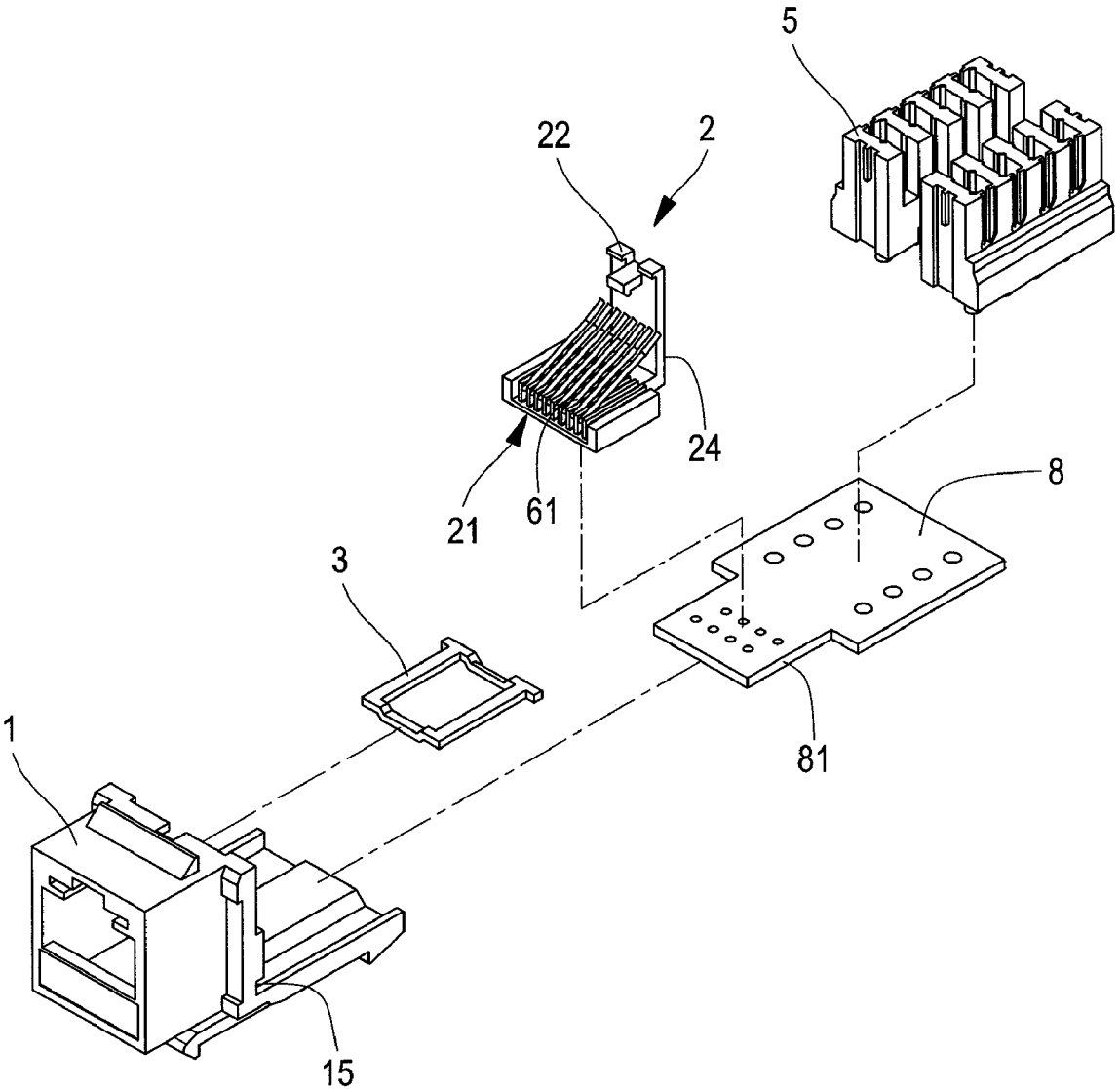
FIG. 12 is an exploded view showing a connection receptacle lock and security structure according to a second embodiment of the present invention.
Figure 13:
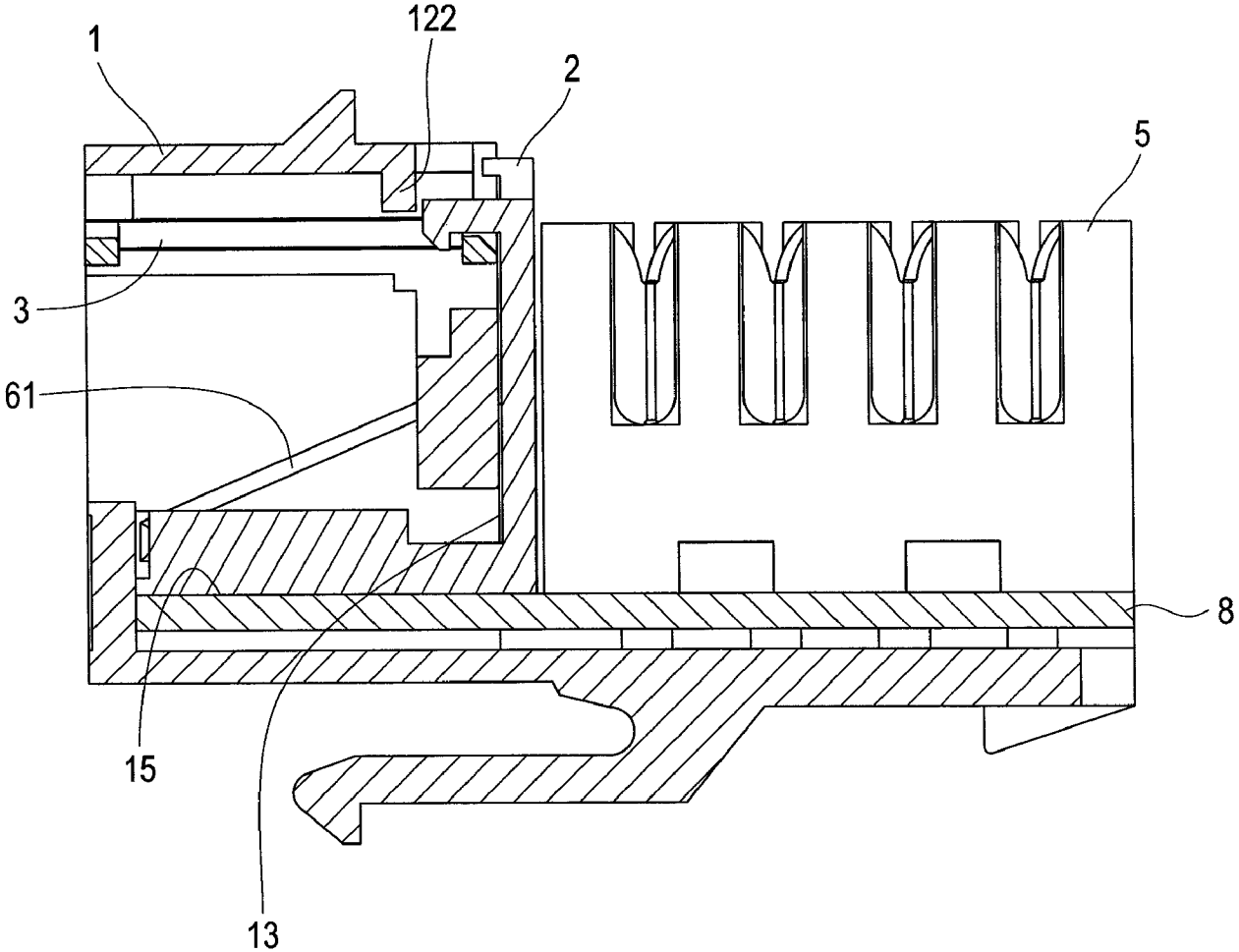
FIG. 13 is a cross-sectional vie showing the use of the connection receptacle lock and security structure according to the second embodiment of the present invention.

Referring to FIGS. 12 and 13, which respectively show an exploded view and a cross-sectional view of a connection receptacle lock and security structure according to a second embodiment of the present invention, the connection receptacle lock and security structure of the present invention allows for re-arrangement of the components according to mold parting applied in a manufacturing process. For example, the fixed end 21 of the pawl portion 2 can be combined with the plurality of conductive wires 61 as a combined assembly and then the terminal housing 5 is mounted to an assembling portion 8 (which is for example a circuit board). The assembling portion 8 has a coupling end 81, which corresponds in position to a coupling slot 15 defined in the connection port 1. When the pawl portion 2 is set adjacent to the end surface 13 of the connection port 1, the terminal housing 5 and the assembling portion 8 that are mounted together are coupled to the connection port 1 by having the coupling end 81 of the assembling portion 8 inserted into the coupling slot 15 of the connection port 1. The remaining components/parts of the second embodiment, as well as coupling, function, and operation thereof, are similar to those of the first embodiment and repeated description is omitted herein.

Figure 14:
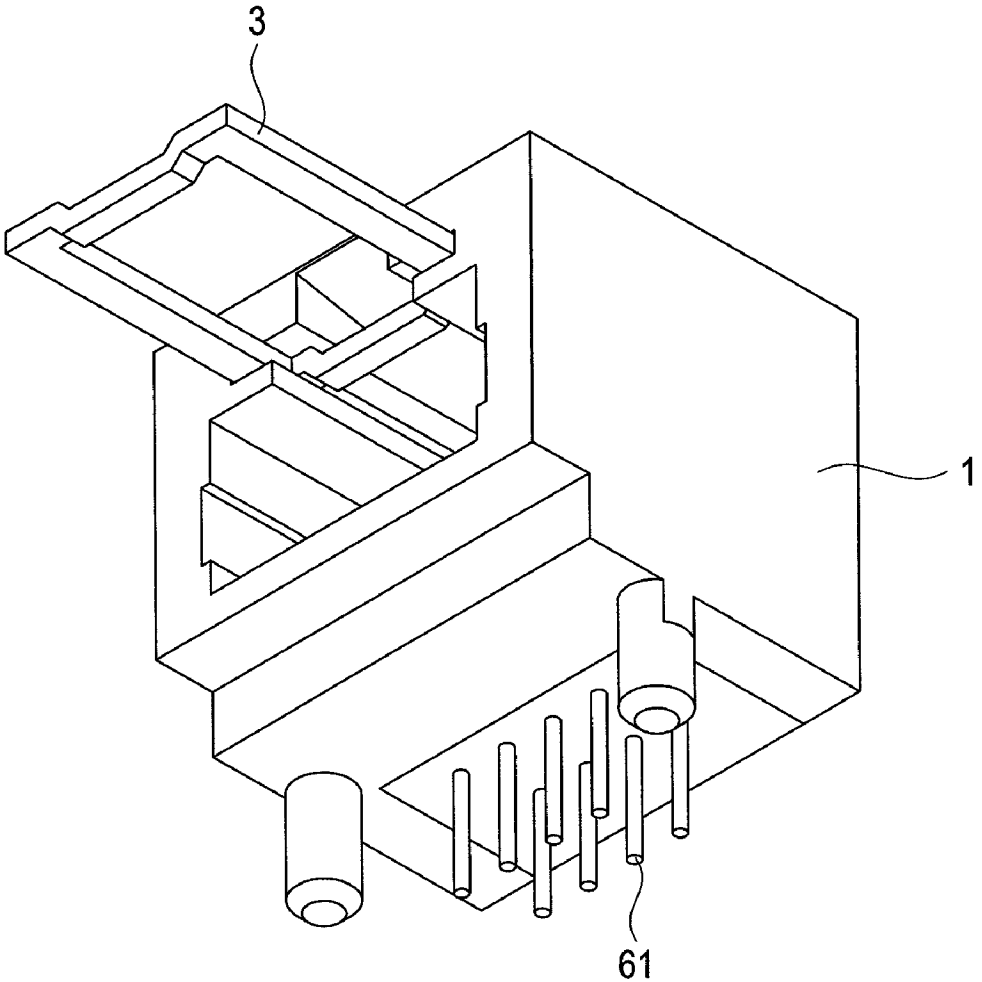
FIG. 14 is a perspective view showing a connection receptacle lock and security structure according to a third embodiment of the present invention.
Figure 15:
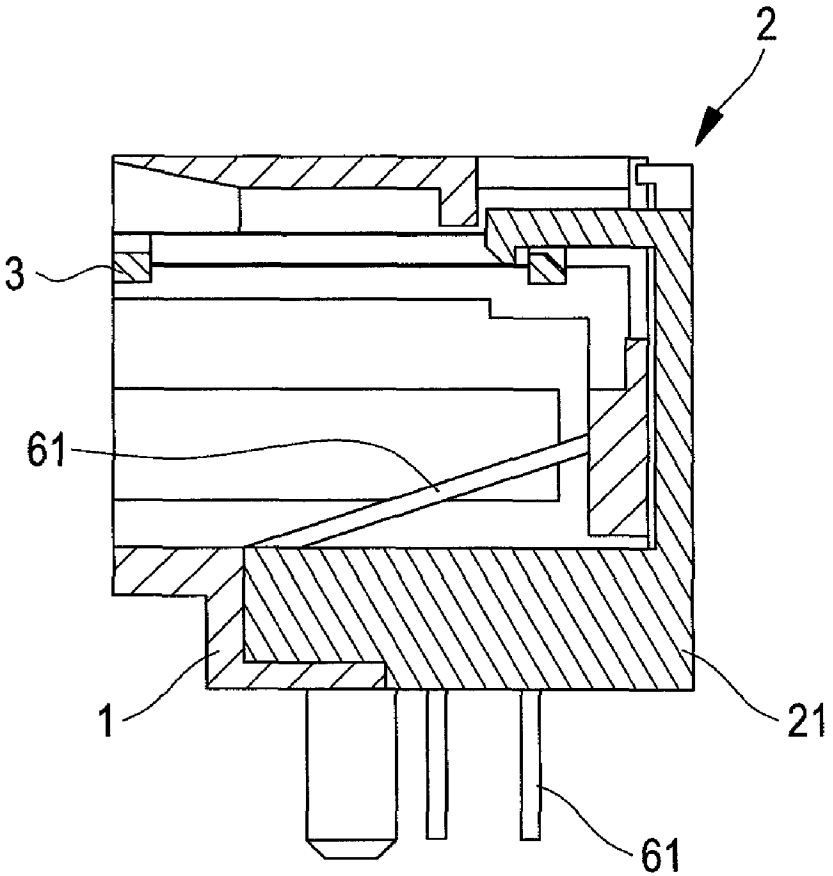
FIG. 15 is a cross-sectional view showing the use of the connection receptacle lock and security structure according to the third embodiment of the present invention.

Referring to FIGS. 14 and 15, which respectively show a perspective view and a cross-sectional view of a connection receptacle lock and security structure according to a third embodiment of the present invention, the fixed end 21 of the pawl portion 2 and the end surface 13 of the connection port 1 are integrated together and the connection port 1 receives and retains therein a plurality of conductive wires 61, which extends out of an end surface of the connection port 1. The remaining components/parts of the third embodiment and the operation thereof with the separator 4 are similar to those associated with the first embodiment and repeated description is omitted herein.

Figure 16:
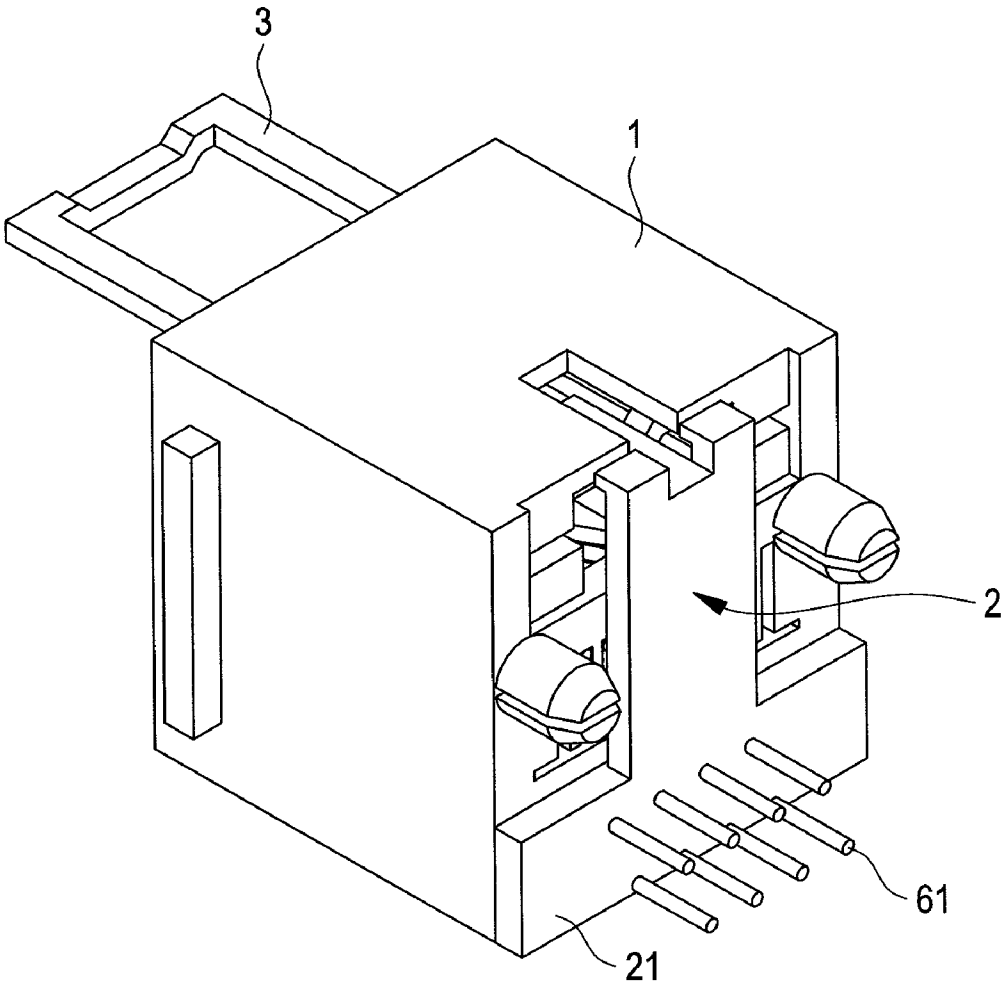
FIG. 16 is a perspective view showing a connection receptacle lock and security structure according to a fourth embodiment of the present invention.
Figure 17:
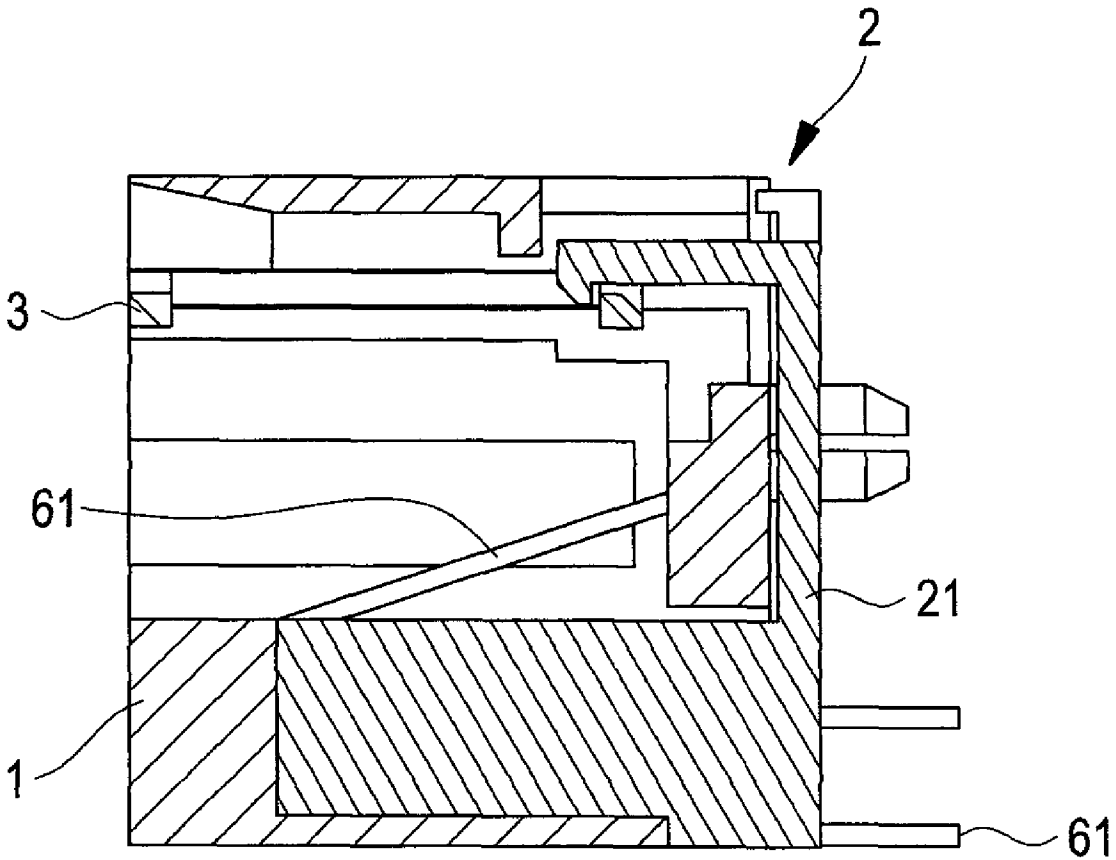
FIG. 17 is a cross-sectional view showing the use of the connection receptacle lock and security structure according to the fourth embodiment of the present invention.

Referring to FIGS. 16 and 17, which respectively show a perspective view and a cross-sectional view of a connection receptacle lock and security structure according to a fourth embodiment of the present invention, the fixed end 21 of the pawl portion 2 and the end surface 13 of the connection port 1 are integrated together and the connection port 1 receives and retains therein a plurality of conductive wires 61, which extends outward through the fixed end 21 of the pawl portion 2. The remaining components/parts of the fourth embodiment and the operation thereof with the separator 4 are similar to those associated with the first embodiment and repeated description is omitted herein.

Figure 18A:
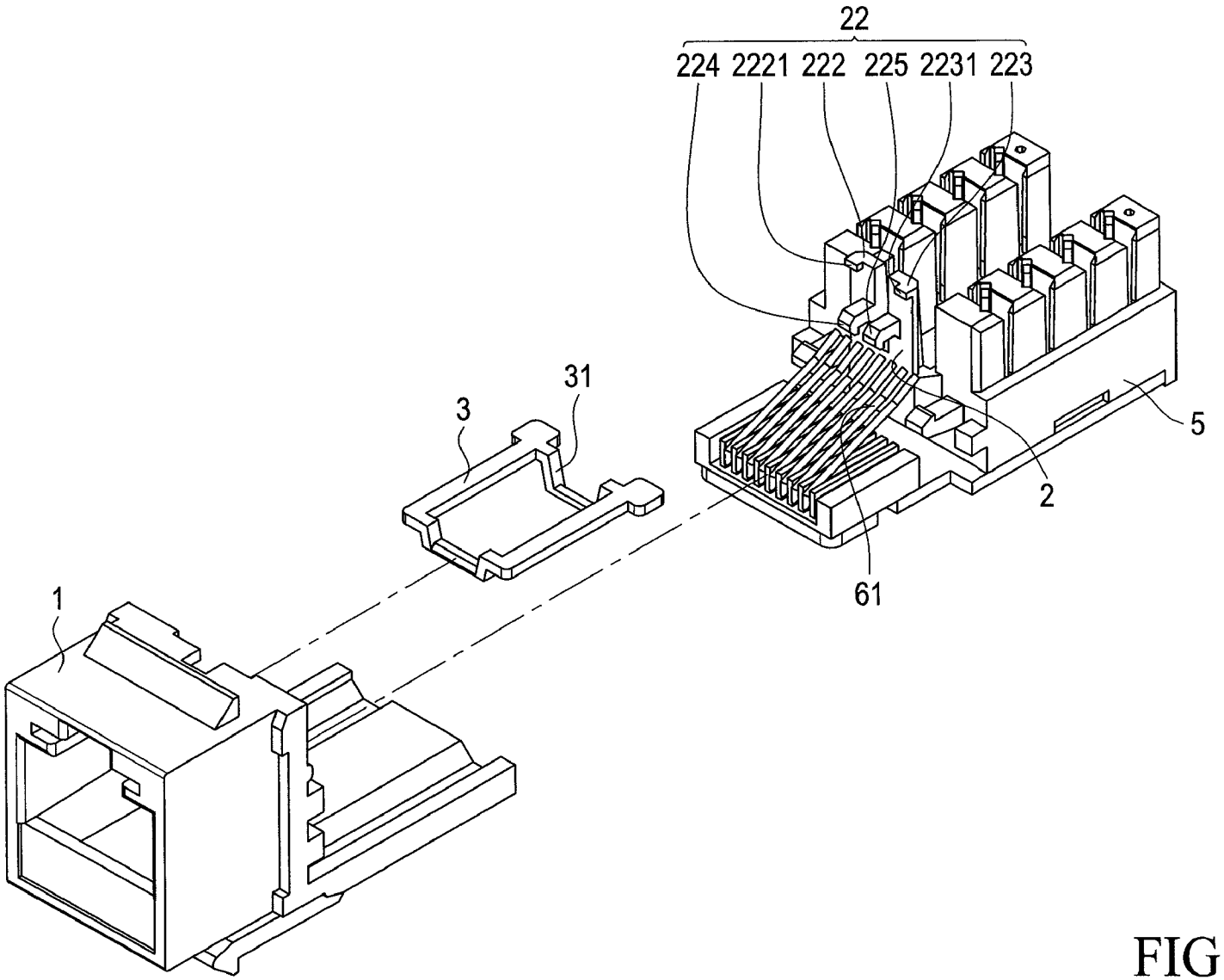
FIG. 18A is an exploded view showing a connection receptacle lock and security structure according to a fifth embodiment of the present invention.
Figure 18B:
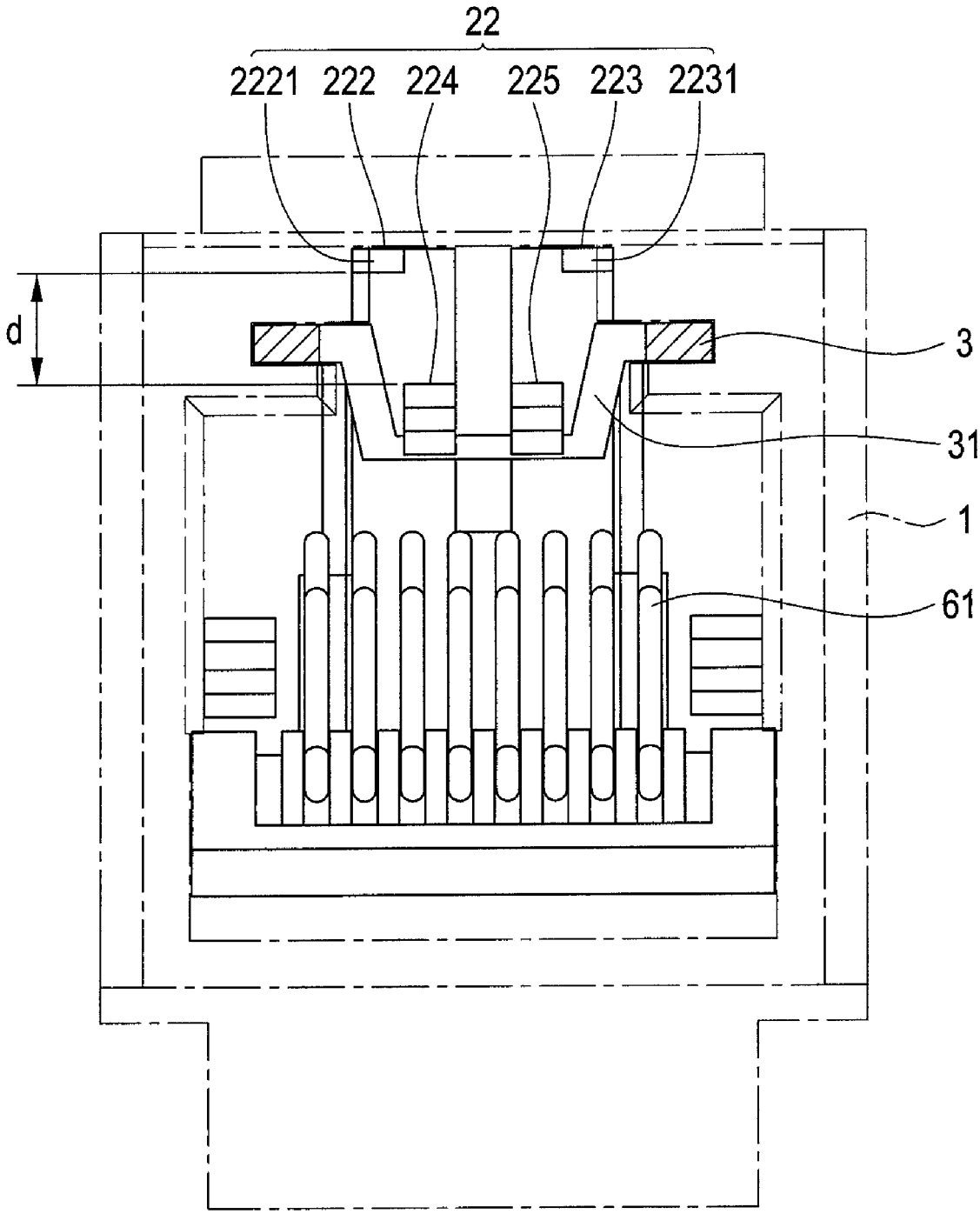
FIG. 18B is an end view showing the use of the connection receptacle lock and security structure according to the fifth embodiment of the present invention.

Referring to FIGS. 18A and 18B, which respectively show an exploded view and an end view of a connection receptacle lock and security structure according to a fifth embodiment of the present invention, the fifth embodiment is substantially similar to the first embodiment and the description of the first embodiment is also applicable to the fifth embodiment for the similarity therebetween. A difference between the two embodiments is that in the fifth embodiment, the free end 22 of the pawl portion 2 forms a first top portion 222, a second top portion 223, a first barb 224, and a second barb 225. The first top portion 222 and the second top portion 223 respectively form a first protrusion 2221 and a second protrusion 2231 extending in a direction toward the receiving space 11. The first barb 224 and the second barb 225 are spaced from the first protrusion 2221 and the second protrusion 2231 of the first top portion 222 and the second top portion 223 of the free end 22 by a distance d. When the lock and security portion 3 is moved to the first position 91, the first barb 224 and the second barb 225 are in engagement with the bar portion 31 of the lock and security portion 3. Since the pawl portion 2 simultaneously comprises the first barb 224 and the second barb 225, the structural strength of the engagement between the pawl portion 2 and the lock and security portion 3 is improved, and to separate the pawl portion 2 and the lock and security portion 3 from each other, the separator 4 must be used. Consequently, the pawl portion 2 of the fifth embodiment does not require the guard surface of the first embodiment to ensure secured engagement and to prevent an unauthorized person using a single sharp-tip object to unlock the connection for stealing or to prevent undesired disconnection. The operation of the fifth embodiment with the separator 4 is similar to that associated with the first embodiment and repeated description is omitted herein.

The connection receptacle lock and security structure according to the present invention features that the combination of the connection port 1, the pawl portion 2, and the lock and security portion 3 can lock and unlock the connection cable 7. The lock and security portion 3 is allow to perform movement in the extension direction of the slide channel 12 and when the lock and security portion 3 reaches the first position 91, the bar portion 31 engages the barb 221, and when the lock and security portion 3 is moved to the second position 92, the bar portion 31 disengages from the barb 221.

The connection receptacle lock and security structure according to the present invention shows the advantages of simple structure, easy assembling, effective prevention of stealing, and easy use. With the operation of the separator 4, a connection cable 7 can be easily fixed to and/or removed from the connection receptacle lock and security structure. This effectively prevents the connection cable 7 from being stolen. Thus, the practicability and convenience of use of the present invention are enhanced.

Although various modifications and variations of the connection receptacle lock and security structure according to the present invention have been shown in the previously discussed embodiments, in practical applications, it suffices for the connection receptacle lock and security structure to work by comprising only a connection port, a pawl portion, and a lock and security portion, wherein the connection port 1 comprises the receiving space 11 and the slide channel 12 that is formed in the surface 111 of the receiving space 11; the pawl portion 2 comprises at least one fixed end 21 and at least one barb 221 located close to the end surface 13 of the connection port 1; and the lock and security portion 3 comprises the bar portion 31 and the board portion 32, the bar portion 31 having an end forming the board portion 32. The lock and security portion 3 is movable along an extension direction of the slide channel 12 so that when the lock and security portion 3 reaches a first position 91, the bar portion 31 engages the barb 221, and when the lock and security portion 3 is moved to a second position 92, the bar portion 31 disengages from the barb 221. This makes the present invention advantageous in the respects of simple structure, easy assembling, effective prevention of stealing, prevention of unauthorized connection, and easy use.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A connection receptacle lock and security structure, comprising:

a connection port, which forms a receiving space and a slide channel, the slide channel being defined in a surface of the receiving space;

a pawl portion, which comprises at least one fixed end, the pawl portion being adjacent to an end surface of the connection port and forming at least one barb; and a lock and security portion, which comprises a bar portion and a board portion, the bar portion being formed on one end of the board portion;

wherein the lock and security portion is movable along an extension direction of the slide channel, whereby when the lock and security portion is moved to a first position, the bar portion engages the pawl portion, and when the lock and security portion is moved to a second position, the bar portion disengages from the pawl portion.

2. The connection receptacle lock and security structure as claimed in claim 1, wherein the barb of the pawl portion forms a first guide surface and the bar portion of the lock and security portion forms a second guide surface corresponding to the first guide surface, whereby when the lock and security portion is moved along the slide channel to the first position, the first guide surface of the pawl portion is forced to move along the second guide surface of the bar portion to bring the pawl portion and the bar portion into engagement with each other.

3. The connection receptacle lock and security structure as claimed in claim 1, wherein the pawl portion is of a cantilever beam like structure, comprising the fixed end and a free end, the fixed end being adjacent to the end surface of the connection port, the free end forming the at least one barb.

4. The connection receptacle lock and security structure as claimed in claim 1, wherein the connection port comprises a plurality of conductive wires, which is set on an opposite surface of the receiving space.

5. The connection receptacle lock and security structure as claimed in claim 1, wherein the pawl portion comprises a plurality of conductive wires and the pawl portion is set close to the end surface of the connection port.

6. The connection receptacle lock and security structure as claimed in claim 1 or 2, wherein the fixed end of the pawl portion and the end surface of the connection port are integrated together, the connection port comprising a plurality of conductive wires, which extends out of the end surface of the connection port.

7. The connection receptacle lock and security structure as claimed in claim 1 or 2, wherein the fixed end of the pawl portion and the end surface of the connection port are integrated together, the connection port comprising a plurality of conductive wires, which extends out of the fixed end of the pawl portion.

8. The connection receptacle lock and security structure as claimed in claim 1, wherein at least one guard surface is formed between the free end and the fixed end, the guard surface comprising two inclined faces respectively formed on two sides of the pawl portion and inclined from a center of the pawl portion toward opposite edges of the two sides.

9. The connection receptacle lock and security structure as claimed in claim 1, wherein the bar portion forms stop blocks on two side portions thereof, whereby when the lock and security portion moves along the slide channel, the stop blocks of the bar portion are set in engagement with a wall of the connection port to stop further movement of the lock and security portion.

10. The connection receptacle lock and security structure as claimed in claim 1, wherein the bar portion and the board portion of the lock and security portion are integrally formed as a unitary frame.

11. The connection receptacle lock and security structure as claimed in claim 1, wherein the slide channel comprises a slide groove formed therein, the slide groove being set in the extension direction of the slide channel and forming therein a guide block.

12. The connection receptacle lock and security structure as claimed in claim 11 further comprising a separator, which is insertable into the slide groove in a direction of extension of the slide groove to be guided by the guide block to contact the free end of the pawl portion for application of a force thereto so as to allow the lock and security portion to move to the second position.

13. The connection receptacle lock and security structure as claimed in claim 12, wherein the board portion forms an opening and the separator forms a projection, which is engageable with a wall of the board portion adjacent to the opening.

14. The connection receptacle lock and security structure as claimed in claim 1 or 2, wherein the fixed end of the pawl portion is mounted to an end surface of a terminal housing, the end surface of the terminal housing opposing the end surface of the connection port.

15. The connection receptacle lock and security structure as claimed in claim 1, wherein the terminal housing comprises at least one coupling member, the receiving space of the connection port comprising at least one retention slot, the coupling member corresponding in position to the retention slot, whereby when the end surface of the terminal housing and the end surface of the connection port are put close to each other, the coupling member of the terminal housing and the retention slot of the connection port mate and couple to each other.

* * * * *